United States Patent [19]

Ng et al.

[11] Patent Number: 4,631,682

[45] Date of Patent: Dec. 23, 1986

[54] METHOD AND APPARATUS FOR CONTROLLING A WINDER FOR STOP-TO-LENGTH OR STOP-TO-ROLL DIAMETER

[75] Inventors: David T. Ng, Rockford, Ill.; Roger C. Brendemuehl, Beloit, Wis.

[73] Assignee: Beloit Corporation, Beloit, Wis.

[21] Appl. No.: 638,408

[22] Filed: Aug. 7, 1984

[51] Int. Cl.[4] ..... B65H 17/12; B65H 25/00

[52] U.S. Cl. ..... 364/471; 242/36; 242/57; 242/67.1 R; 242/75.51

[58] Field of Search ..... 364/470, 471; 242/36, 242/57, 67.1 R, 75.51, 184, 186, 190

[56] References Cited

U.S. PATENT DOCUMENTS

| | | | |
|---|---|---|---|
| 4,438,889 | 3/1984 | Schonmeier | 242/57 |
| 4,494,203 | 1/1985 | Suzuki | 364/470 |
| 4,535,949 | 8/1985 | Olsson | 242/57 |
| 4,553,569 | 11/1985 | Kimbara et al. | 364/470 |

*Primary Examiner*—Jerry Smith
*Assistant Examiner*—Allen MacDonald
*Attorney, Agent, or Firm*—Dirk J. Veneman

[57] ABSTRACT

A control system provides automatic control of winder deceleration and stopping to a preset sheet length, or preset roll diameter. The system utilizes a closed loop control of drive deceleration and automatic compensation for layers slabbed off following a sheetbreak.

7 Claims, 5 Drawing Figures

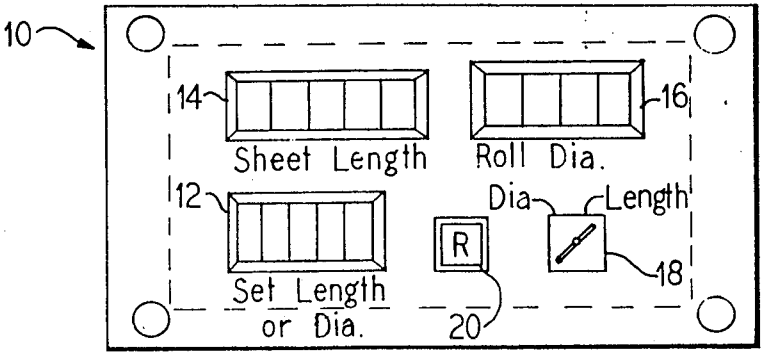
FIG. 1
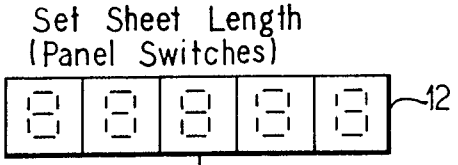
FIG. 2
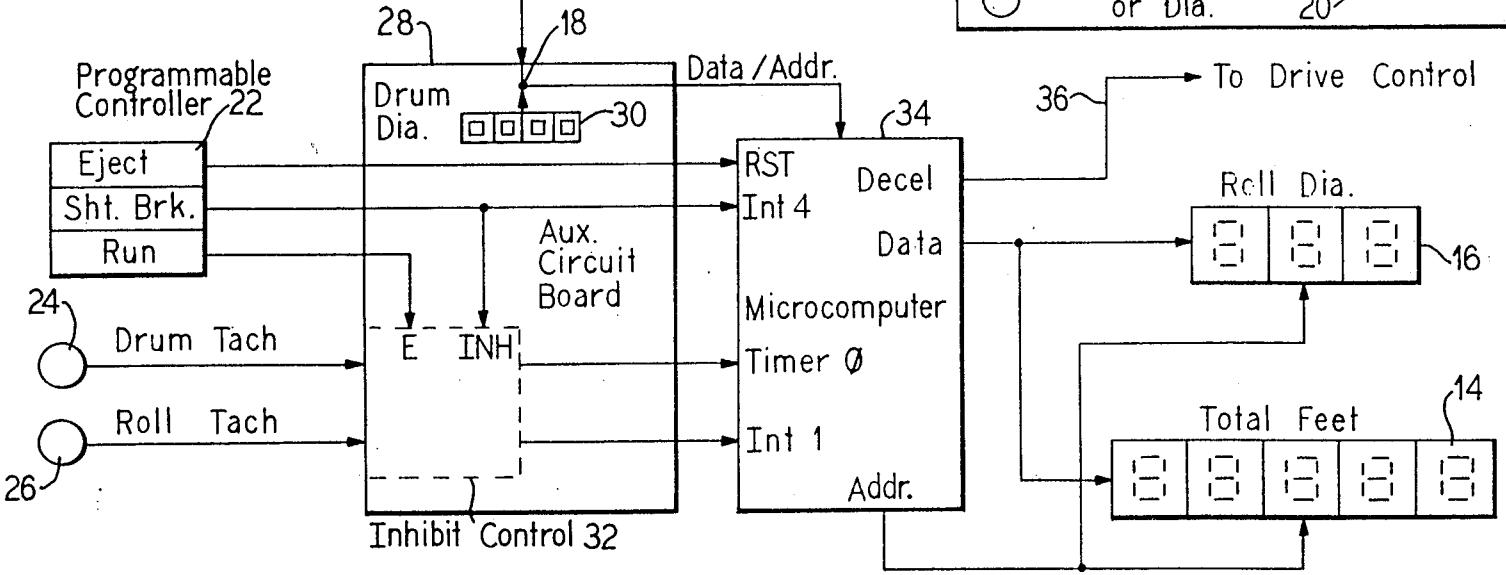

METHOD AND APPARATUS FOR CONTROLLING A WINDER FOR STOP-TO-LENGTH OR STOP-TO-ROLL DIAMETER

BACKGROUND OF THE INVENTION

1. Field of the Invention

The present invention relates to a control for a paperwinder, and is more particularly concerned with controlling the winder to stop at a preset web length or a preset roll diameter.

2. Description of the Prior Art

Papermill customers generally purchase finished paper rolls specified to a guaranteed sheet length on the roll or a roll wound to a guaranteed diameter. Controls are commercially available for stopping a winder at a preset sheet length, but not to a specified roll diameter. Also, conventional stop-to-length controls do not provide closed loop control of winder deceleration and, instead, utilize a two-level stop mode. The winder deceleration starts at an initial set point at a rate fixed by the drive, and continues to some preset slow speed. The winder then runs at this low speed to the second or final stop point. This method can achieve accurate sheet length control; however, it requires a longer stopping time.

The ASEA Rolltrimmer is a system of the type set forth above with respect to stop-to-length control.

Schommeier U.S. Pat. No. 4,438,889 discloses a computer system for controlling stopping length by switching the drive control between two rates of deceleration; one slightly greater than the desired rate and one slightly less than the desired rate.

SUMMARY OF THE INVENTION

It is the object of the present invention, therefore, to provide a method and apparatus for controlling a winder to automatically and accurately stop at a specified sheet length or specified roll diameter.

An attendant object of the present invention is to provide that the winder deceleration be accurately controlled at a specified rate.

Another object of the invention is to provide an accurate stop control in minimum time to either a specified sheet length or roll diameter while providing compensation for damaged layers removed in the event of sheet break during winding.

Another object of the invention is to provide a microprocessor-based control system to automate paperwinding to a preset length or a preset diameter, either in English or metric units.

The above objects are achieved, according to the present invention, by providing a microprocessor-base control system which accurately controls the winding of paper on a roll and in which a number of essential parameters are known, either as preprogrammed data, measured data or operator inputs. These parameters include the decelerate rate of the drive, the target length or diameter, paper thickness, (caliper), and paper speed. The stopping distance, as a function of paper speed, is computed continuously. Whenever the sum of the stopping distance and cumulative length is greater than the target length, the drive starts to decelerate. It is essential to maintain a constant deceleration rate, so that the stopping distance computation will depend only on the paper speed and not on the inertia of the roll.

The drive switches between two deceleration rates. The assumed deceleration will be the arithmetic mean of these two rates. The computer tells the drive to start deceleration and the drive switches to the high deceleration rate. Therefore, the computed stopping distance will be longer than the actual stopping distance. On a subsequent calculation, the computer signals the drive not to decelerate and the drive switches to the low deceleration rate. This process is continuously repeated as the drive slows down. The deceleration rate therefore depend on a so-called "bang-bang" control in which the control loop is active down to zero speed.

With most drive systems, a time lag exists from the instant the computer issues a deceleration command to the time the drive starts to slow down. A time advanced factor is required to compensate for the response lag. The need for such compensation is more obvious if the paper is winding at a low speed.

In the control-to-diameter mode, the stopping distance along with the caliber of the paper enables computation of the stopping diameter. The relationship between incremental length to incremental diameter is employed to compute a paper "slabbed off" after a sheet break. At the instant of sheet break, the instantaneous diameter is memorized and when winding is resumed (after slab off and splicing) an up-date diameter is computed. The computer will make an automatic adjustment of the cumulative footage based on these data.

In the stop-to-length mode, the computer accepts as inputs the signal pulses from a drum tachometer (500 ppr), a roll tachometer (1 ppr) and three status flags, namely, sheetbreak, run and eject from a programmable control, for example, an Allen-Bradley PLC-2 programmable control. The drum tachometer pulses are cummulated in a counter $\phi$ (16 bits) of a computer, for example an Intel ISBC 80/24 computer. A software counter (16 bits) is linked to the counter $\phi$ to enable storage of $4{,}300\times10^6$ counts.

The roll tachometer pulses are input to the computer as a first interrupt (when the computer acknowledges this interrupt, it computes the incremental drum pulses from the previous roll tachometer interrupt. Therefore, this routine essentially computes the ratio of the drum tachometer frequency to the roll tachometer frequency. This ratio, along with the program drum diameter, furnishes the information on the wound up roll diameter, updated every wound up layer of paper.

The target footage or diameter is entered by way of thumbwheel switches on a benchboard. The drum diameter is also entered by way of binary-coded decimal (BCD) switches located on an auxiliary circuitboard. The caliper of paper is entered through a keyboard connected to a roll structure computer and is subsequently passed on to the stop-to-length computer. The caliper is required for estimating the equivalent number of layers slabbed off after a sheetbreak. These set points are read during initialization only (beginning of a new row).

The computer outputs the wound up roll diameter, and accumulative footage to operate light emitting diodes (LED) displays mounted on the benchboard. Other outputs include a deceleration flag, a stop flag to the programmable controller and the drive, and a layer counting flag to the roll structure computer for density computation.

The sample rate in a particular embodiment of the invention for closed loop control is half a second. The sample rate clock is a counter (counter 1) of the Intel ISBC 80/24 computer. At countdown, it generates a second interrupt which invokes the routine that pushes the cumulative drum tach count into a last sample count, then reads the current cumulative drum tach count from the counter 5.

A sheetbreak signal from the programmable control disables drum tach pulse counting and roll tach pulse interrupt, thus freezing the wound up roll diameter and cumulative footage on the displays. The computer also memorizes the current roll diameter and raises an internal sheetbreak flag.

The run signal from the programmable controller enables drum tach and roll tach counting, therefore resuming update of cumulative footage and wound up diameter.

An eject signal from the programmable controller initializes the stop-to-length computer. The displayed roll diameter and footage will be reset. The target length or diameter and the caliper are read in for the next roll.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 is a front view of a control panel for a cut-to-length/cut-to-diameter control including a display of length and diameter, an encoder input for length and a core chuck sensor;

FIG. 2 is a block circuit diagram of a control constructed in accordance with the present invention;

FIG. 5 is a strip chart recording of drive speed and switching of the deceleration rate.

DESCRIPTION OF THE PREFERRED EMBODIMENTS

Figures 3, 4:
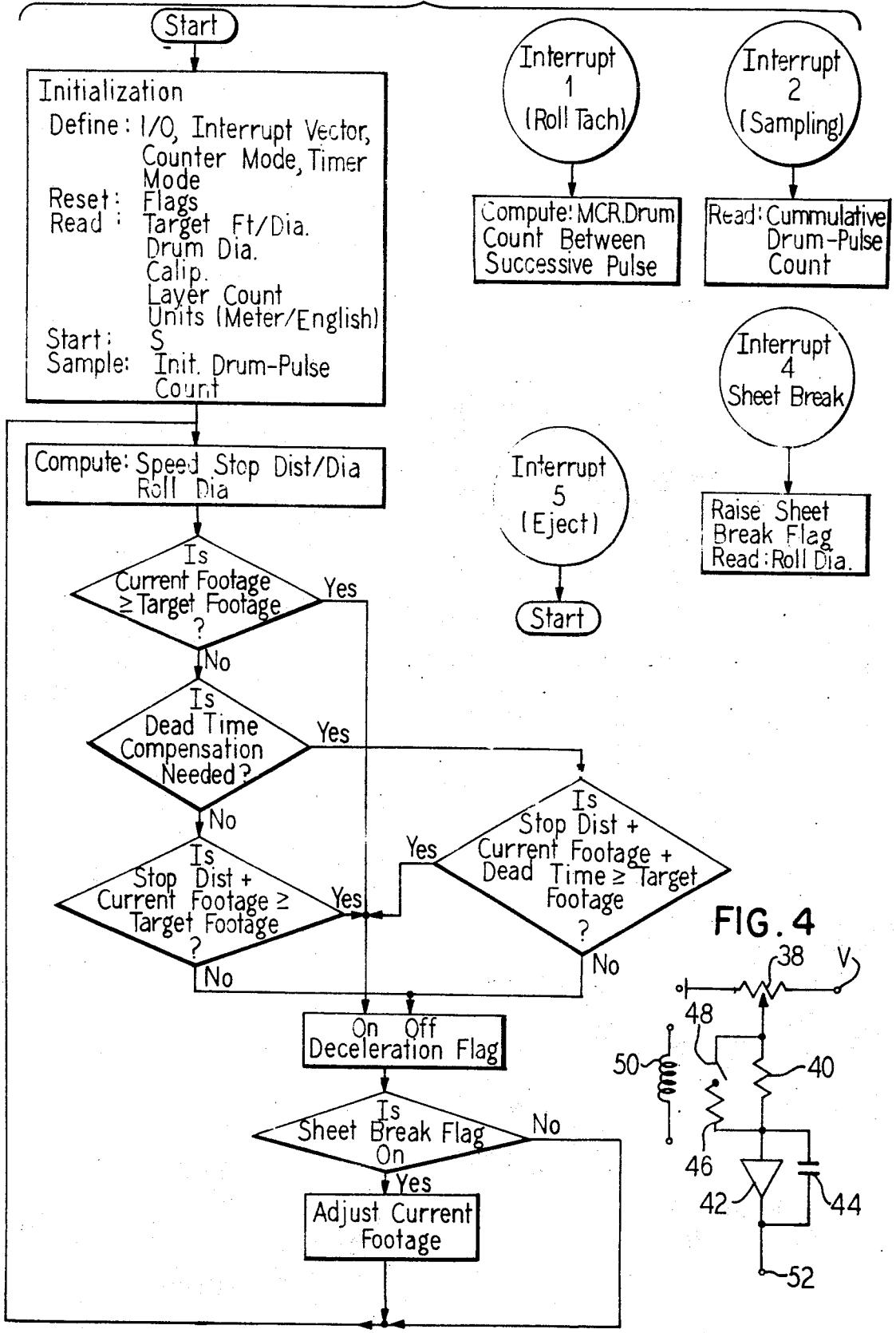
FIG. 3 is a flow chart which sets forth the operation of the circuit of FIG. 2.
FIG. 4 is a schematic circuit diagram of a modification of an existing drive control for accomplishing "bang-bang" operation.

Referring to FIGS. 1 and 2, a control channel and a system block diagram are illustrated. The control panel 10 comprises a plurality of control elements or indicators including a sheet length display 14, a rolled diameter display 16, a diameter/length selection switch 18, length set switches 12 and a core chuck sensor (indicator) 20 which may also double as a run switch.

In FIG. 2 the control system is illustrated as comprising the panel switches 12 and drum diameter selection switches 30, both set of switches being connected to the diameter/length switch 18. As an alternative, the panel switches 12 may also function as the drum diameter switches 30 on the front panel of FIG. 1 through the actuation of the switch 18.

At the left side of FIG. 2, a programmable control 22, for example the aforementioned Allen-Bradley PLC-2 controller is illustrated as providing three signal, namely EJECT,SHT.BRK. and RUN. Also, a drum tachometer 24 and a roll tachometer 26 are illustrated. The programmable control 22 and the tachometers 24 and 26 are connected to and/or through an auxiliary circuitboard 28 which includes an inhibit control 32 having the inputs E and INH. The EJECT signal passes directly through the auxiliary circuitboard 28 to an input RST of a microcomputer 34, for example the aforementioned INTEL ISBC 80/24 computer. The SHT.BRK. signal is connected to the INH input of the inhibit control 32 and to an interrupt input INT4 of the microcomputer 34. The inhibit control 32 provides a signal to the counter or timer $\phi$ of the microcomputer 34 and an interrupt signal to the input INT1of the microcomputer 34.

The microcomputer 34 provides the aforementioned outputs, in particular the outputs to the roll diameter display 16 and to the length display 14, and an output to the drive control to complete a closed loop back through the programmable control 22 and the tachometers 24 and 26.

The system illustrated in FIGS. 1 and 2 and the circuit of FIG. 4 operate in accordance with the flow chart of FIG. 3 and in accordance with the appended computer program and as described above in the summary of the invention.

More specifically, after initialization, the main program constantly computes speed from the difference between the current and last drum tachometer counts and the programmed sample rate. The anticipated stopping distance is computed from the speed and the drive deceleration rate. If the sum of the anticipated stopping speed and the cumulative footage is greater than the target length, the deceleration flag is raised. The drive, after receiving this signal from the output 36, will switch to a deceleration rate greater than the programmed rate, this switching being set forth below with respect to FIG. 4. This switching causes the speed to drop below the anticipated value at some subsequent sample. As a consequence, the newly-computed stopping distance will be smaller than anticipated, the deceleration flag will be lowered, and the drive will be switched back to a deceleration rate lower than the programmed value. The rate of speed change will drop and a subsequent computation of the stopping distance will again raise the deceleration flag. Therefore, a bang-bang control of the deceleration is provided down to zero speed. Because of the time lag in the drive, which occurs the first time the deceleration flag is raised, a time advance factor is programmed in to compensate for this one-time system "dead time".

In the control-to-diameter configuration, the anticipated stopping diameter is computed from the stopping distance. To account for the possible layers slabbed off after a sheetbreak, the caliper, the last value of roll diameter before sheetbreak, and the new diameter after run is resumed are used for computing the decremental footage. The formulae for various computations are set forth below on the basis of the equation $$D = V^2/2a$$

where D is equal to the distance, V is the velocity and a is the rate of deceleration.

The stopping distance may be computed, on the basis of the Fortran language as $$D = (\text{speed} ** 2)/2 * a.$$

The stopping diameter may be calculated in accordance with $$D(NT) = \left\{ \frac{48c}{\pi} - \frac{V^2[(N-1)T]}{2a} + D^2[(N-1)T] \right\}^{\frac{1}{2}}$$

where

V[(N−1)T] is the speed of the roll in ft/sec computed from the last sample;

D[(N−1)T] is the roll diameter in inches at the last sample;

D(NT) is the stopping distance;

c is the caliper of the paper in inches; and a is the rate of deceleration in ft/sec$^2$.

Based on a 500 ppr drum tachometer rate, the decremental drum tachometer count may be calculated from the relationship $$\Delta CT = 500(D_L^2 - D_I^2)/96c$$

where

ΔCT is the decremental drum tach count;

$D_L$ is the last diameter before sheetbreak; and $D_I$ is the new diameter after sheetbreak.

The resolution of the drum tachometer is 1/500 or 0.2%. Therefore, the resolution limit of layers is $$\frac{(\text{Roll Diameter}) \times 0.2\%}{2c}.$$

For example for a 30 inch roll and a caliper of 0.002 inch, the resolution error is 15 layers of 118 feet. The error in total footage is 0.2% of the final layer. Thus, for a 60 inch roll, the error is only 4 inches.

Referring to FIG. 4, a modification of an existing drive control is illustrated in which the existing drive control comprises a variable resistor 38 connected to a reference voltage V for establishing a reference rate via a resistor 40 and an amplifier 42 having a feedback capacitor 44. This circuit provides a speed reference at an output 52. In order to change the rate of deceleration, it is conventional on drives using analog control circuits to adjust a voltage fed to a speed reference integrator, as in this circuit. The deceleration can then be easily switched between two rates by switching the time constant of the integrator. In the present modification of this circuit, this is easily accomplished by switching another resistor 46 in parallel with the resistor 40 by way of relay contacts 48 and a relay winding 50 controlled by the deceleration control 36 of the microcomputer 34.

The present system has been constructed and operated in accordance with the strip charts of FIG. 5 which illustrates the drive speed and switching of deceleration rate for a set sheet length of 4750 feet and a stop length of 4755 feet. This run is typical. One will note the lag time of the drive, from the deceleration command to the actual start of deceleration is about 2.5 seconds. The results of a series of consecutive runs setting various sheet lengths and winder speeds are set forth below.

| WINDER SPEED (Ft/Min) | SET LENGTH (Feet) | ACTUAL LENGTH (Feet) | ERROR (Feet) |
|---|---|---|---|
| 2000 | 5000 | 4994 | −6 |
| 2000 | 5000 | 4995 | −5 |
| 1500 | 3000 | 2990 | −10 |
| 1500 | 3000 | 2993 | −7 |
| 4000 | 6000 | 5995 | −5 |
| 3000 | 6000 | 5994 | −6 |
| 4000 | 6000 | 5999 | −1 |
| 3000 | 6000 | 5997 | −3 |
| 6000 | 6000 | 5995 | −5 |
| 5000 | 6000 | 6000 | 0 |
| 4000 | 4000 | 4000 | 0 |
| 3500 | 4000 | 3990 | −10 |

As mentioned, the system operates in accordance with the appended program and in accordance with the flow chart of FIG. 3.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of my contribution to the art.

MAIL ROOM JUL 7 1986 41 PAT. & TRADE MARK OFF.

BELOIT S T L

SOFTWARE DOCUMENTATION

Copyright (c) 1983, Beloit Corporation

TABLE OF CONTENTS :

I. SOFTWARE SPECIFICATION

II. SYSTEM DESIGN

III. HARDWARE IMPLEMENTATION

IV. CODE

BELOIT CORPORATION
COMPUTER CONTROLS GROUP

S T L

CONTROL TO LENGTH/DIA.

SOFTWARE SPECIFICATION

Date : June 9, 1983
Last Revision :

Author(s) : David Ns

I. INTRODUCTION

The Beloit Control to Length/Diameter Controller is a microprocessor based control system for providing automatic control of winder deceleration and stopppins to a preset sheet length, or roll diameter. It operates as a subsystem of the Research winder automatic control. Unique features of the system are closed loop control of drive deceleration and automatic compensation for layers slabbed off following a sheet break.

Tests on the Research winder save sheet length accuracy of 10 feet of the preset length and roll diameters within 0.05 inches of the preset diameter.

Minor modifications to the drive control circuits were required to obtain the closed loop deceleration fearture.

II. SPECIFICATIONS

A. Inputs

1. The unit of the controlled parameter (length/diameter) can be in English or Metric. It is entered during initialization of the accompanying roll structure control computer via a keyboard. The stop to length/diameter computer reads this data from common memory shared with RSC during its initialization.( pressing reset button on the winder benchboard or receiving the eject signal from the Allen Bradley PLC-2 programmable controller)

2 The caliper of paper is also entered through the RSC's keyboard during the RSC initialization. STL computer reads this value again from common memory. The caliper is needed for estimating the equivalent slabbed off length from the decremental in roll diameter. The RSC will keep on updating the caliper as paper is being wound. The STL reads this data only at the occurrence of a sheet break. (interrupt 4) this data is in floating point format.

3. The drum diameter is entered through the RSC keyboard and read by STL during initialization at common memory. The format will be in floating point.

4 The drum tachometer will have 500 p.p.r.. This signal is conditioned

5. The roll tachometer will have 1 p.p.r.. This signal is conditioned and converted to TTL level by circuitry on the auxiliary board.

6. The sheetbreak signal is TTL level and come from the PLC-2. It inhibits the drum tachometer and roll tachometer pulses from reaching the STL interrupt lines.

7. The run signal is TTL level and come from the PLC-2. It enables drum tachometer and roll tachometer pulses to reach the STL interrupt inputs.
two stop bits should be transmitted.

8. The eject signal is TTL level and come from the PLC-2. It initialize

9. The target footage or diameter is entered by means of thumbwheel switches on the bench board.

10 A reset buttom on the winder benchboard will initialize the STL. This is the manual backup for the eject signal.

B. Outputs

1. A three digits value of roll diameter, down to a tenth of unit will be displayed on a LED display mounted on the bench board.

2. A five digits value of total footage ,down to an integer foot will be displayed on a LED display mounted on the bench board 3. A deceleration flag will be outputed to the PLC-2 and drive control 4. A layer count flag will be outputed to the RSC at the completion of every layer.

5. A stop flag will be issued to the PLC-2 when the winder speed drops below a certain speed by the circuitry on the auxiliary board.

III. HARDWARE CONSIDERATIONS

A. BOARDS

1. The STL system will be implemented using the following standard board :

a. Intel 80/24 CPU Board

2. In addition, the STL unit will contain a BELOIT designed board used to control the winder drive. This board will interface the CPU board to the PLC-2, the drum tachometer, the roll tachometer and the drive. It also contains the tension control circuitry.

BELOIT CORPORATION
COMPUTER CONTROLS GROUP

S T L

(STOP TO LENGTH/DIAMETER)

SOFTWARE DESIGN

Date : June 10, 1983
Last Revision : Original

Author(s) : David Ng

Table of Contents

I. OVERVIEW

II. VARIABLES

III. PROCEDURES

I. OVERVIEW

A. SYSTEM DESCRIPTION

The stop-to length/ diameter computer acepts as inputs the signal pulses from the drum tachometer (500 p.p.r.), the roll tachometer (1 p. p.r.) and the three status flags -- namely, sheetbreak,run and eject from the Alley Bradley PLC-2 programmable controller. The drum tachometer pulses are accumulated in counter 0 (16 bits) of the intel ISB 80/24 computer board. A software counter (16 bits) is linked to counter 0 to enable storage of 4,300 million count. The roll-tachometer pulses enter the computer as interrupt 1. Whenever the computer acknowledges this interrupt, it computes the incremental drum pulses from the previous roll-tachometer interrupt. Thus this routine essentially computes the ratio of the drum tachometer frequency to the roll-tachometer frequency. This ratio alons with the programmed drum diameter furnishes information on thw wound up roll diameter updated every wound up layer of paper.

The tarset footage or diameter is entered by means of thumbwheel switches on the bench board. The drum diameter is also entered through BCD switches loacted on the auxilary circuit board. The caliper of paper is entered through the keyboard connected to the roll structure computer and subsequently passed on to the stop-to-length computer. The caliper is needed for estimating the equivalent number of layers slabbed off after a sheetbreak. These setpoints are read during initialization only.( beginning of a new roll)

The computer outputs the wound up roll diameter, and cummulative footage to LED displays mounted on the benchboard. Other outputs include a deceleration flag, a stop flag to the programmable controller and the drive, and a layer count-down flag to the roll structure computer for density computation.

The sample rate for closed loop control is approximately half a second (487.7ms). The sample rate clock is counter 1 of the Intel ISBC 80/24 computer board. At countdown, it generates interrupt 2 which invokes the routine that pushes the cummulative drum-tachometer count into the last sample count, then reads in the current cummulative drum-tachometer count from counter 0.

The sheetbreak signal from PLC-2 disables drum-tachometer pulse counting and roll-tachometer interupt, thus freezing the wound up roll diameter and cummulative footage on the displays. This is performed by hardware circuitry on the auxilary board. The computer also memorizes the current roll diameter and raises the internal sheetbreak flag.

The Run signal from the PLC-2 enables drum-tachometer and roll tachometer counting, thus resuming update of cummulative footage and wound up diameter. This is done by hardware circuitry on the auxilary board.

The Eject signal from the PLC-2 initializes the stop-to length/diameter computer. The displayed roll diameter and footage will be reset. The target length or diameter and the caliper are read in for the next roll.

A system block diagram is shown in figure 1.

B. SOFTWARE DESCRIPTION

After initialization, the main program keeps on computing the speed from the difference between the current and last drum-tachometer counts and the programmed sample rate. The anticipated stopping distanvce is then computed from the speed and the drive deceleration rate. If the sum of the anticipated stopping distance and the cummulative footage is greater than the target length, the deceleration flag is raised. The drive, after receiving this signal, will switch to a deceleration rate greater than the programmed rate. This causes the speed to drop below the anticipated value at some subsequent sample. As a consequence, the new computed stopping distance will be smaller than anticipated, the deceleration flag will be lowered, and the drive then switches to a deceleration rate lower than the programmed value. The rate of speed change will drop and a subsequent computation of the stopping distance will again raise the deceleration flag. Thus we have a bang-bang control on the deceleration down to zero speed. Because of the time lag in the drive, occuring the first time the deceleration flag is raised, a time advanced factor is programmed in to compensate for this one-time system "dead time".

In the control to diameter version, the anticipated stopping diameter is computed from the stopping distance. To account for the possible layers slabbed off after a sheetbreak, the caliper, the last value of roll diameter before sheetbreak, and the new diameter after run is resumed are used for computing the decremental footage. The formulae for various computations are listed as follows:

1. Stopping distance = (speed**2)/2*deceleration.

2. D(NT)= (48*calip*V[(N-1)T]**2 / pi*2a + D[(N-1)T]2)1/2
   = (48*calip*L[(N-1)T]/pi + D[(N-1)T]2)1/2 where V[(N-1)T] is the speed in ft/sec computed from last sample
   D[(N-1)T] is the roll diameter in in. at last sample
   D[NT] is the stopping diameter in in. at the current sample
   calip is the caliper of paper in in.
   L[(N-1)T] is the stopping distance in ft. at the last ssample
   a is the deceleration in ft/sec2.

3. DELTA$CT = 500*(Df2 - Di2)/96*calip where DELTA$CT is the decremental drum-tachometer count
   Df is the last diameter before sheetbreak
   Di is the new diameter after sheetbreak The above formula has included the 500 p.p.r. of the drum-tachometer

3. DRIVE MODIFICATION

As stated above, closed loop control of the rate of drive deceleration is achieved by "bang-bang" control. The control operates by switching the drive deceleration between two rates, one slisthly greater than the calculated value and one slisthly less than the calculate value. On drives using analog control circuits, the deceleration rate is usually set by adjusting a voltage fed to a speed reference integrator. The deceleration can then be easily switched between two rates by switching the time constant of the integrator. The circuit used on the Research Winder Drive, to accomplish this rate switching, is shown in figure 3. On the C.H. drive, both circuit points 1 and 2 were acessible on external terminal connectors so that no p.c. board modification were necessary.

II.VARIABLES

| SYMBOL | TYPE | NAME | MODULE |
|---|---|---|---|
| BCDD | (5) Byte | Diameter in BCD | FCMAIN |
| BCDL | (5) Byte | Total footage in BCD | " |
| CUDRUMCT | (2) Address | Current drumcount | " |
| CURPUSCT | (2) Address | Current pulsecount | " |
| DEC$FLAG | Byte | Deceleration flag | FCDECL |
| DRUM$CT | (2) Address | Drum Count | FCMAIN |
| F2DECL | (4) Byte | Twice deceleration in floating point | " |
| FADJSL | (4) Byte | Length adj. constant | DISPLY |
| FCALIP | (4) Byte | Caliper in floating pt. | FCMAIN |
| FDELTAT | (4) Byte | time between sample in floating point | " |
| FFTSC | (4) Byte | footage conversion factor in floating point | " |
| FNUM2 | (4) Byte | Numerial 2 in floating pt. | " |
| FPR | (18) Byte | Floating pt. accumulator | " |
| FRDSC | (4) Byte | Diameter conversion factor in floating point | " |
| FROLD | (4) Byte | Roll diameter in floating pt. | DISPLY |
| FSPEED | (4) Byte | speed in floating pt. | FCSTPD |
| FSPEED1 | (4) Byte | Last speed in floating pt. | " |

| | | | |
|---|---|---|---|
| FSTOPD | (4) Byte | Stopping distance in floating point | FCMAIN |
| FTAR$FT | (4) Byte | Target footage in floating point | " |
| FTAR$TOL | (4) Byte | Target footage tolerance in floating point | " |
| FTOTFT | (4) Byte | Total footage in floating point | DISPLY |
| INIT$CNT | Byte | Initial layer count | FCMAIN |
| LADRUMCT | (2) Address | Last drum count | FCMAIN |
| LASPUSCT | (2) Address | Last pulse count | " |
| LAYER$CTR | Byte | Layer counter | " |
| LENADJ$FLAG | Byte | Length adjust flag | " |
| LFROL | (4) Byte | Latched roll diameter after sheetbreak | FCITR |
| PULSEC | (4) Byte | Pulse count | FCMAIN |
| SHBR$FLAG | Byte | Sheetbreak flag | " |
| TADV | Byte | Time advance flag | " |
| UDPCTR | Address | Upper 16 bit software drum counter | " |

III. PROCEDURES

The following is a brief description of the public procedures used by the STL main program or associated modules.

Name : IOINT
Language ASM80
In Module : FCIOI.ASM

Function : Define PPI #1 port A in, B out, C in; PPI #2 port A, B & C out.

Name : PICINT
Language ASM80
In Module : FCIOI.ASM

Function : Set ICW1 to 64 byte block and edge trigger.

Name : SETR
Language : ASM80
In Module : FCRTI.ASM

Function : Initialize counter #1 as sample rate clock for a period of 487.7 mSec.

Name : SETCT
Language : ASM80
In Module : FCPCI.ASM

Function : Initialize counter #0 to FFFFH for drum pulse countdown

Name : PCRD
Language : ASM80.ASM
In Module : FCPCRD.ASM

Function : Read counter #0 , LSB first, then MSB; take 1's complement, then store at location of argument.

Name : READ$SETPOINTS
Language : PLM80
In Module : FCCINT.PLM

Function : Read Target footage, drum diameter and convert them to floating point numbers Name : STOP$DISTANCE
Language : PLM80
In Module : FCSTPD.PLM Function : Compute speed and stopping distance Name : DECELERATION
Language : PLM80
In Module : FCDECL.PLM Function : If current footage, or current footage plus stopping distance is greater than target footage, the raise the deceleration flag. Add 'dead time' compensation if it is the first time through deceleration loop Name : BI$BCD
Language : PLM80
In Module : DISPLY.PLM Function : 17 bit binary to 5 digits BCD conversion.

Name : DISPLY
Language : PLM80
In Module : DISPLY.PLM

Function : Repack and output data to LED display

Name : LENADJ
Language : PLM80
In Module : DISPLY.PLM

Function : Slabbed off compensation

Name : DATADISPLAY
Language : PLM80
In Module : DISPLY.PLM

Function : Compute and display total footage and wound up roll diameter with automatic slabbed off compensation.

Name : RPITR
Language : PLM80
In Module : FCITR.PLM

Function : Interrupt 1, roll pulse interrupt routine

Name : SRITR
Language : PLM80
In Module : FCITR.PLM

Function : Interrupt 2, re-initialize sample clock and sample drum-pulse count.

Name : DPITR
Language : PLM80
In Module : FCITR.PLM

Function : Interrupt 3, decrement upper 16 bit software counter for total drum pulse count Name : SHTBR
Language : PLM80
In Module : FCITR.PLM Function : Interrupt 4, raise sheetbreak flag and latch in roll diameter value Name : RESET
Language : PLM80
In Module : FCITR.PLM Function : Interrupt 5, re-initialize the whole program, controlled by the PLC-2 EJECT signal

NOTES

NOTES

NOTES

NOTES

BOARD CONFIGURATION FOR STL

80/24

JUMPERS IN
(Note - (*) denotes that this jumper must be added to new boards)

```
    176 - 177   5 Volts to P2
    158 - 159   9.68 MHz BCLK/
    160 - 161   BPRO/
    164 - 165   9.68 MHz CCLK/
    125 - 126   9.68 MHz CPU Clock
    142 - 145   RAMACK/ to READY
    140 - 143   FAILSAFE TIMER Enabled
    178 - 179   INTA/
    180 - 181   BMTO/
    148 - 149   4K of RAM
*   150 - 151   RAM Mapped at F000H-FFFFH
     26 -  27   E4 to INPUT
     28 -  42   \
     29 -  43    \
     30 -  44     \
     31 -  45      \
     40 -  42       \
     45 -  46        \  J1 CONFIGURATION
     32 -  47        /
     33 -  48       /
     34 -  49      /
     35 -  50     /
     36 -  51    /
     37 -  51   /
     56 -  70   \       E8 TO OUTPUT
     57 -  71    \
     71 -  69     \
     58 -  72      \
     59 -  73       \
     60 -  74        >  J2 CONFIGURATION
     74 -  75       /
     62 -  76      /
     63 -  77     /
     64 -  78    /
     65 -  79   /
     17 -  18   Internal RxC
     18 -  19   Internal TxC
```

```
*   129 - 133   REMOVED
*   130 - 134   REMOVED
*   128 - 134   ADDED, CONNECT DIVIDED DOWN SYSTEM CLK TO CLK1
*   102         GROUNDED, IR0
*   101 - 106   REMOVED
*   101 - P2,10 ADDED FOR ROLL PULSE IR1
*   100 - 118   REMOVED
*   103 - 100   ADDED, TIMER1 O/P TO IR2, 0.5 SEC SAMPLE CLOCK
*   133 - P2,5  ADDED, DRUM PULSE I/P
*   118 -  99   ADDED, TIMER0 O/P TO IR3, UPPER SOFTWARE CTR
*    98 - P2,11 ADDED FOR SHEETBREAK IR4
*    96         GROUNDED, IR6
*    97 - P2,9  ADDED, IR5 RESTART
```

ADDITIONAL DEVICES:

| | |
|---|---|
| XU3 | JUMPER |
| XU4 | JUMPER |
| XU5 | 7408 |
| XU6 | 7408 |
| XU8 | 7408 |
| XU9 | 7408 |
| XU10 | 7408 |
| XU11 | 7408 |

J8 CONFIGURED FOR 2764 PROMS (empty)

J7 CONFIGURED FOR 2764 PROMS

PIN 2 - PIN 13
PIN 3 - PIN 12
PIN 4 - PIN 11
PIN 5 - PIN 10
PIN 6 - PIN 9

STL Vx.x 2764.1 installed in U50
(Note : remove shorting pluss in U50 to U53)

BELOIT S T L MEMORY MAP

| ADDRESS | MAPPING |
|---|---|
| 0000 - 1FFF | R O M - 1 X 2764<br>Located on 80/24 CPU |
| 2000 - BFFF | *** N O T M A P P E D *** |
| C000 - EFFF | *** N O T M A P P E D *** |
| F000 - FFFF | On Board R A M<br>Located on 80/24 CPU |

BELOIT S T L I/O MAP

| ADDRESS | MAPPING |
|---|---|
| D8 - DB | 8259A INTERRUPT CONTROLLER |
| DC | 8253 INTERVAL TIMER 0 LOAD/READ COUNT (DRUMPULSE CTR) |
| DD | 8253 INTERVAL TIMER 1 LOAD/READ COUNT (SAMPLE CLOCK) |
| DF | 8253 INTERVAL TIMER MODE CONTROL |
| E4 | I/P DRUM DIAMETER,DEC.RATE,ENG./METRIC,LENGTH/DIA. |
| E5 | O/P DISPLAY DATA |
| E6 | I/P TARGET FOOTAGE DATA |
| E7 | PPI#1 CONTROL |
| E8 | O/P<br>BIT 0 DEC$FLAG<br>BIT 1 LAYER$CTR INTRPT O/P |
| E9 | O/P BITS 0 TO 6 INPUT ADD. MUX.<br>BIT 0 TO 2 TARGETFT. ADD. ACTIVE 'HI'<br>BIT 3 TO 4 DRUMDIA. ADD. ACTIVE 'LO'<br>BIT 5 DEC.RATE ADD. ACTIVE 'LO'<br>BIT 6 ENG./METRIC ADD. ACTIVE 'LO'<br>LENGTH/DIA. |
| EA | O/P BITS 0 TO 4 DISPLAY ADD. MUX.<br>BIT 0 TO 1 DIA. DISPLAY ADD. ACTIVE 'LO'<br>BIT 2 TO 4 FT. DISPLAY ADD. ACTIVE 'LO' |
| EB | PPI#2 CONTROL |

BELOIT S T L INTERRUPT MAP

| INTERRUPT | FUNCTION |
|---|---|
| INT0 | NOT USED |
| INT1 | ROLL PULSE |
| INT2 | 0.5 SEC SAMPLE RATE (TIMER 1) |
| INT3 | UPPER SOFTWARE DRUMPULSE CTR FROM TIMER 1 |
| INT4 | SHEETBREAK |
| INT5 | RESTART FROM EJECT SIGNAL |
| INT6 | NOT USED |
| INT7 | NOT USED |
| 7.5 | NOT USED |
| 6.5 | NOT USED |
| 5.5 | NOT USED |
| TRAP | NOT USED |

```
ISIS-II PL/M-80 V3.1 COMPILATION OF MODULE MAINMOD
OBJECT MODULE PLACED IN :F1:FCMAIN.OBJ
COMPILER INVOKED BY:  PLM80 :F1:FCMAIN.PLM DEBUG


        /*********************************************************************/
        /*                                                                   */
        /*            BELOIT CORPORATION PLM PROGRAM DOCUMENTATION           */
        /*                                                                   */
        /*     Title :     MAIN FOOTAGE CONTROL PROGRAM                      */
        /*                                                                   */
        /*     Author :    David T. Ng                                       */
        /*                                                                   */
        /*     Date Written  : MAY 5,1983                                    */
        /*     Last Revision : -------                                       */
        /*                                                                   */
        /*     File Type : MAIN                                              */
        /*                                                                   */
        /*     Description of Operation :                                    */
        /*                                                                   */
        /*     This is the main program of the Stop to Length Computer,      */
        /*     calling the various functional modules.                       */
        /*                                                                   */
        /*     Calling Sequence :  NONE                                      */
        /*                                                                   */
        /*     Definition of Formal Parameters : NONE                        */
        /*                                                                   */
        /*     Procedures Called : IOINT,PICINT,SETR,SETCT,PCRD(.A),         */
        /*                         READ$SETPOINTS,DECELERATION,STOP$DISTANCE, */
        /*                         DATADISPLAY.                              */
        /*                                                                   */
        /*     Revisions :     1) []                                         */
        /*                     2) []                                         */
        /*                     3) []                                         */
        /*                     4) []                                         */
        /*                                                                   */
        /*********************************************************************/


1       MAINMOD:    /* MAIN FOOTAGE CONTROL PROGRAM */
           DO;

2  1    PCRD:
                PROCEDURE (A) EXTERNAL;
3  2            DECLARE A ADDRESS;
4  2            END PCRD;

5  1    SETCT:
                PROCEDURE EXTERNAL;
6  2            END SETCT;

7  1    SETR:
                PROCEDURE EXTERNAL;
8  2            END SETR;
```

```
 9  1     IOINT:
                 PROCEDURE EXTERNAL;
10  2            END IOINT;

11  1     PICINT:
                 PROCEDURE EXTERNAL;
12  2            END PICINT;

13  1     READ$SETPOINTS:
                 PROCEDURE EXTERNAL;
14  2            END READ$SETPOINTS;

15  1     STOP$DISTANCE:
                 PROCEDURE EXTERNAL;
16  2            END STOP$DISTANCE;

17  1     DECELERATION:
                 PROCEDURE EXTERNAL;
18  2            END DECELERATION;

19  1     DATADISPLAY:
                 PROCEDURE EXTERNAL;
20  2            END DATADISPLAY;

21  1     FSET:
                 PROCEDURE(FA,OP1,OP2) EXTERNAL;
22  2                DECLARE (FA,OP1,OP2) ADDRESS;
23  2            END FSET;

24  1     FSTOR:
                 PROCEDURE (FA,FB) EXTERNAL;
25  2                DECLARE (FA,FB) ADDRESS;
26  2            END FSTOR;

27  1     FMUL:
                 PROCEDURE (FA,FB) EXTERNAL;
28  2                DECLARE (FA,FB) ADDRESS;
29  2            END FMUL;

30  1     FDIV:
                 PROCEDURE (FA,FB) EXTERNAL;
31  2                DECLARE (FA,FB) ADDRESS;
32  2            END FDIV;

33  1     FLTDS:
                 PROCEDURE (FA,FB) EXTERNAL;
34  2                DECLARE (FA,FB) ADDRESS;
35  2            END FLTDS;

36  1            DECLARE DRUM$CT (2) ADDRESS PUBLIC;
37  1            DECLARE PULSEC (4) BYTE PUBLIC;
38  1            DECLARE INIT$CNT BYTE PUBLIC DATA(0C8H);
                 /* FOOTAGE TOLERANCE = .0' */
39  1            DECLARE FTAR$TOL (4) BYTE PUBLIC DATA(0,0,00H,00H);
                 /* SAMPLING INTERVAL = 487.7 mS */
40  1            DECLARE FDELTAT (4) BYTE PUBLIC DATA(0D0H,0B3H,0F9H,3EH);
```

```
                    /* DECELREATION = 2 FT./SEC-SEC */
41   1              DECLARE F2DECL (4) BYTE PUBLIC DATA(00H,00H,80H,40H);
                    /* NUMERIAL TWO */
42   1              DECLARE FNUM2 (4) BYTE PUBLIC DATA(0,0,0,40H);
                    /* CALIPBER = .0029" */
43   1              DECLARE FCALIP (4) BYTE PUBLIC DATA(00H,0EH,3EH,3BH);
44   1              DECLARE LAYER$CTR BYTE PUBLIC;
45   1              DECLARE FPR (18) BYTE PUBLIC;
46   1              DECLARE FTAR$FT (4) BYTE PUBLIC;
47   1              DECLARE FSTOPD (4) BYTE PUBLIC;
48   1              DECLARE BCDD (5) BYTE PUBLIC;
49   1              DECLARE BCDL (5) BYTE PUBLIC;
50   1              DECLARE FRDSC (4) BYTE PUBLIC;
51   1              DECLARE FFTSC (4) BYTE PUBLIC;
52   1              DECLARE CUDRUMCT (2) ADDRESS PUBLIC;
53   1              DECLARE LADRUMCT (2) ADDRESS PUBLIC;
54   1              DECLARE CURPUSCT (2) ADDRESS PUBLIC;
55   1              DECLARE LASPUSCT (2) ADDRESS PUBLIC;
56   1              DECLARE UDPCTR ADDRESS PUBLIC;
57   1              DECLARE TADV BYTE PUBLIC;
58   1              DECLARE LENADJ$FLAG BYTE PUBLIC;
59   1              DECLARE SHBR$FLAG BYTE PUBLIC;
60   1              DECLARE I BYTE;

                        /*INITIALIZTION - READ SETPOINTS & RESET COUNTER */

61   1      MAIN:   LAYER$CTR = INIT$CNT;
62   1              UDPCTR = 0FFFFH;
63   1              TADV = 00H;
64   1              LENADJ$FLAG = 00H;
65   1              SHBR$FLAG = 00H;

66   1              CALL IOINT;
67   1              CALL PICINT;
68   1              CALL READ$SETPOINTS;
69   1              CALL SETR;
70   1              CALL SETCT;
71   1              CALL PCRD(.DRUM$CT);
72   1              CALL PCRD(.PULSEC);

73   1              DO I = 0 TO 1;
74   2                  LASPUSCT(I) = PULSEC(I);
75   2              END;

                        /* MAIN CONTROL LOOP */
76   1      LOOP:   CALL STOP$DISTANCE;
77   1              CALL DECELERATION;
78   1              CALL DATADISPLAY;
79   1              GO TO LOOP;

80   1          END MAINMOD;

MODULE INFORMATION:

   CODE AREA SIZE     = 0087H    135D
   VARIABLE AREA SIZE = 004BH     75D
   MAXIMUM STACK SIZE = 0002H      2D
   161 LINES READ
   0 PROGRAM ERROR(S)

END OF PL/M-80 COMPILATION
```

```
LOC  OBJ        LINE        SOURCE STATEMENT

                  1
                  2 ;*********************************************************************
                  3 ;*                                                                   *
                  4 ;*      BELOIT CORPORATION ASSEMBLY LANGUAGE PROGRAM DOCUMENTATION   *
                  5 ;*                                                                   *
                  6 ;*      Title :         SET I/O MODE & PIC FOR EDGE TRIGGER INTERRUPT *
                  7 ;*                                                                   *
                  8 ;*      Author :        David T. Ng                                  *
                  9 ;*                                                                   *
                 10 ;*      Date Written  : MAY 5,L983                                   *
                 11 ;*      Last Revision : -------                                      *
                 12 ;*                                                                   *
                 13 ;*      File Type : PROCEDURE PUBLIC                                 *
                 14 ;*                                                                   *
                 15 ;*      Description of Operation :                                   *
                 16 ;*                                                                   *
                 17 ;*      DEFINE PPI #1 PORT A IN, B OUT, C IN; PPI #2 PORT A,B & C OUT; *
                 18 ;*      SET ICW1 TO 64 BYTE BLOCK & EDGE TRIGGER                     *
                 19 ;*                                                                   *
                 20 ;*      Calling Sequence :      CALL IOINT,CALL PICINT               *
                 21 ;*                                                                   *
                 22 ;*      Definition of Formal Parameters : NONE                       *
                 23 ;*                                                                   *
                 24 ;*      Subroutines Called :    NONE                                 *
                 25 ;*                                                                   *
                 26 ;*      Registers Affected :    NONE                                 *
                 27 ;*                                                                   *
                 28 ;*      Revisions:      1) []                                        *
                 29 ;*                      2) []                                        *
                 30 ;*                      3) []                                        *
                 31 ;*                      4) []                                        *
                 32 ;*                                                                   *
                 33 ;*********************************************************************
                 34
                 35
                 36
                 37
                 38
                 39 $        TITLE('SET I/O MODE & PIC FOR EDGE TRIGGER INTRP')
                 40          NAME DEFIO
                 41          PUBLIC IOINT
                 42          PUBLIC PICINT
                 43
                 44          CSEG
                 45
0000 3E99        46 IOINT:   MVI A,99H       ;MODE WORD(PPI #1 PORT A IN,B OUT,C IN)
0002 D3E7        47          OUT 0E7H        ;SEND MODE WORD TO PP #1
0004 3E80        48          MVI A,80H       ;MODE WORD(PPI #2 PORT A, B & C OUT)
0006 D3EB        49          OUT 0EBH        ;SEND MODE WORD TO PPI #2
0008 3EFF        50          MVI A,0FFH      ;DISABLE I/P MUX
000A D3E9        51          OUT 0E9H
000C 3E1F        52          MVI A,1FH
000E D3EA        53          OUT 0EAH
0010 C9          54          RET
```

```
LOC  OBJ        LINE        SOURCE STATEMENT
                                  - - - -
                  55
0011 3E12         56 PICINT: MVI A,12H       ;SET ICW1 TO 64 BYTE BLK & EDGE TRIGGER
0013 D3D8         57         OUT 0D8H
0015 3E00         58         MVI A,0
0017 D3D9         59         OUT 0D9H
0019 3EC1         60         MVI A,0C1H      ;MASK OFF INT. 0,6,7
001B D3D9         61         OUT 0D9H
001D FB           62         EI
001E C9           63         RET
                  64         END

PUBLIC SYMBOLS
IOINT  C 0000   PICINT C 0011

EXTERNAL SYMBOLS

USER SYMBOLS
IOINT  C 0000   PICINT C 0011

ASSEMBLY COMPLETE,  NO ERRORS


ISIS-II PL/M-80 V3.1 COMPILATION OF MODULE INIT
OBJECT MODULE PLACED IN :F1:FCCINT.OBJ
COMPILER INVOKED BY:  PLM80 :F1:FCCINT.PLM DEBUG

/*********************************************************************/
/*                                                                   */
/*            BELOIT CORPORATION PLM PROGRAM DOCUMENTATION           */
/*                                                                   */
/*     Title :     READ FOOTAGE & DIAMETER SETTING                   */
/*                                                                   */
/*     Author :    David T. Ng                                       */
/*                                                                   */
/*     Date Written  : MAY 5, L983                                   */
/*     Last Revision : -------                                       */
/*                                                                   */
/*     File Type : PROCEDURE PUBLIC                                  */
/*                                                                   */
/*     Description of Operation :                                    */
/*                                                                   */
/*     READ TARGET FOOTAGE & DRUM DIAMETER AND CONVERT THEM TO       */
/*     FLOATING POINT NUMBERS.                                       */
/*                                                                   */
/*     Callins Sequence :  CALL READ$SETPOINTS                       */
/*                                                                   */
/*     Definition of Formal Parameters : NONE                        */
/*                                                                   */
/*     Procedures Called : FSET,FSTOR,FQFD2B,FLOAD,FMUL.             */
/*                                                                   */
/*     Revisions :     1) []                                         */
/*                     2) []                                         */
/*                     3) []                                         */
/*                     4) []                                         */
/*                                                                   */
/*********************************************************************/
```

```
1          INIT:   /* READ FOOTAGE & DIA SETTING */
               DO;

2   1      FSET:
               PROCEDURE (FA,OP1,OP2) EXTERNAL;
3   2          DECLARE (FA,OP1,OP2) ADDRESS;
4   2          END FSET;

5   1      FQFD2B:
               PROCEDURE (FA,FB) EXTERNAL;
6   2          DECLARE (FA,FB) ADDRESS;
7   2          END FQFD2B;

8   1      FSTOR:
               PROCEDURE (FA,FB) EXTERNAL;
9   2          DECLARE (FA,FB) ADDRESS;
10  2          END FSTOR;

11  1      FLOAD:
               PROCEDURE (FA,FB) EXTERNAL;
12  2          DECLARE (FA,FB) ADDRESS;
13  2          END FLOAD;

14  1      FMUL:
               PROCEDURE (FA,FB) EXTERNAL;
15  2          DECLARE (FA,FB) ADDRESS;
16  2          END FMUL;

17  1          DECLARE FTAR$FT (4) BYTE EXTERNAL;
18  1          DECLARE FRDSC (4) BYTE EXTERNAL;
19  1          DECLARE FFTSC (4) BYTE EXTERNAL;
20  1          DECLARE FFR (18) BYTE EXTERNAL;
21  1          DECLARE FSPEED1 (4) BYTE EXTERNAL;

22  1      READ$SETPOINTS:
               PROCEDURE PUBLIC;
23  2          DECLARE TAR$FT (3) BYTE;
24  2          DECLARE DRUM$DIA (2) BYTE;
25  2          DECLARE DTAR$FT (5) BYTE;
26  2          DECLARE FDRUM$DIA (4) BYTE;
27  2          DECLARE FK$1 (4) BYTE DATA(20H,42H,09H,3AH); /*  PI/500(12) */
28  2          DECLARE FK$2 (4) BYTE DATA(0AH,0D7H,0A3H,3CH); /* 10/500 */
29  2          DECLARE DDRUM$DIA (4) BYTE;
30  2          DECLARE CONTROL STRUCTURE(SIGN BYTE,SCALE ADDRESS,SLENGTH
               BYTE,STRING$PTR ADDRESS),STRING(6) BYTE;

31  2          OUTPUT(0E9H) = 19H;
32  2          TAR$FT(0) = INPUT(0E6H);
33  2          OUTPUT(0E9H) = 1AH;
34  2          TAR$FT(1) = INPUT(0E6H);
35  2          OUTPUT(0E9H) = 1CH;
36  2          TAR$FT(2) = INPUT(0E6H);
37  2          OUTPUT(0E9H) = 18H;
38  2          DTAR$FT(0) = (TAR$FT(0) AND 0FH)+ '0';
39  2          DTAR$FT(1) = TAR$FT(1)/16       + '0';
40  2          DTAR$FT(2) = (TAR$FT(1) AND 0FH)+ '0';
```

```
41  2          DTAR$FT(3) = TAR$FT(2)/16      + '0';
42  2          DTAR$FT(4) = (TAR$FT(2) AND 0FH)+ '0';

43  2          CALL FSET(.FPR,0,0);
44  2          CALL FSTOR(.FPR,.FSPEED1);
45  2          CONTROL.SIGN = '+';
46  2          CONTROL.SCALE = 0;
47  2          CONTROL.SLENGTH = 5;
48  2          CONTROL.STRING$PTR = .DTAR$FT;
49  2          CALL FQFD2B(.FPR,.CONTROL);
50  2          CALL FSTOR(.FPR,.FTAR$FT);

51  2          OUTPUT(0E9H) = 10H;
52  2          DRUM$DIA(0) = NOT INPUT(0E4H);
53  2          OUTPUT(0E9H) = 08H;
54  2          DRUM$DIA(1) = NOT INPUT(0E4H);
55  2          OUTPUT(0E9H) = 18H;
56  2          DDRUM$DIA(0) = DRUM$DIA(0)/16      + '0';
57  2          DDRUM$DIA(1) = (DRUM$DIA(0) AND 0FH) + '0';
58  2          DDRUM$DIA(2) = DRUM$DIA(1)/16      + '0';
59  2          DDRUM$DIA(3) = (DRUM$DIA(1) AND 0FH) + '0';
60  2          CONTROL.SIGN = '+';
61  2          CONTROL.SCALE = 0FFFEH;
62  2          CONTROL.SLENGTH = 4;
63  2          CONTROL.STRING$PTR = .DDRUM$DIA;
64  2          CALL FQFD2B(.FPR,.CONTROL);
65  2          CALL FSTOR(.FPR,.FDRUM$DIA);
66  2          CALL FLOAD(.FPR,.FK$1);
67  2          CALL FMUL(.FPR,.FDRUM$DIA);
68  2          CALL FSTOR(.FPR,.FFTSC);
69  2          CALL FLOAD(.FPR,.FK$2);
70  2          CALL FMUL(.FPR,.FDRUM$DIA);
71  2          CALL FSTOR(.FPR,.FRDSC);

72  2       END READ$SETPOINTS;
73  1       END INIT;


MODULE INFORMATION:

    CODE AREA SIZE     = 0156H    342D
    VARIABLE AREA SIZE = 001EH     30D
    MAXIMUM STACK SIZE = 0004H      4D
    128 LINES READ
    0 PROGRAM ERROR(S)

END OF PL/M-80 COMPILATION
```

```
LOC  OBJ        LINE        SOURCE STATEMENT

                  1
                  2 ;*********************************************************************
                  3 ;*                                                                   *
                  4 ;*      BELOIT CORPORATION ASSEMBLY LANGUAGE PROGRAM DOCUMENTATION   *
                  5 ;*                                                                   *
                  6 ;*      Title :         SAMPLE RATE INITIALIZATION                   *
                  7 ;*                                                                   *
                  8 ;*      Author :        David T. Ng                                  *
                  9 ;*                                                                   *
                 10 ;*      Date Written  : MAY 5,1983                                   *
                 11 ;*      Last Revision : -------                                      *
                 12 ;*                                                                   *
                 13 ;*      File Type : PROCEDURE PUBLIC                                 *
                 14 ;*                                                                   *
                 15 ;*      Description of Operation :                                   *
                 16 ;*                                                                   *
                 17 ;*      INITIALIZE COUNTER 1 AS SAMPLE RATE CLOCK FOR A PERIOD       *
                 18 ;*      OF 487.7 mS.                                                 *
                 19 ;*                                                                   *
                 20 ;*      Calling Sequence :      CALL SETR                            *
                 21 ;*                                                                   *
                 22 ;*      Definition of Formal Parameters : NONE                       *
                 23 ;*                                                                   *
                 24 ;*      Subroutines Called :    NONE                                 *
                 25 ;*                                                                   *
                 26 ;*      Registers Affected :    NONE                                 *
                 27 ;*                                                                   *
                 28 ;*      Revisions:      1) []                                        *
                 29 ;*                      2) []                                        *
                 30 ;*                      3) []                                        *
                 31 ;*                      4) []                                        *
                 32 ;*                                                                   *
                 33 ;*********************************************************************
                 34
                 35
                 36
                 37
                 38
                 39 $        TITLE('SAMPLE RATE TIMER INT. ')
                 40          NAME SAMPLE
                 41
0070             42          T1M0  EQU 070H
00DF             43          TMODE EQU 0DFH
00DD             44          T1    EQU 0DDH
00FF             45          RLSB  EQU 0FFH
00FF             46          RMSB  EQU 0FFH
                 47          PUBLIC SETR
                 48
                 49          CSEG
                 50
0000 3E70        51 SETR:    MVI A,T1M0;     SETUP TIMER 1 MODE 0
0002 D3DF        52          OUT TMODE
0004 3EFF        53          MVI A,RLSB;     LOAD RATE = 0.4877 SEC
0006 D3DD        54          OUT T1
```

```
LOC  OBJ        LINE        SOURCE STATEMENT

0008 3EFF        55          MVI A,RMSB
000A D3DD        56          OUT T1
000C C9          57          RET
                 58          END

PUBLIC SYMBOLS
SETR   C 0000

EXTERNAL SYMBOLS

USER SYMBOLS
RLSB   A 00FF   RMSB   A 00FF   SETR   C 0000   T1     A 00DD   T1MO   A 0070   TMODE  A 00DF

ASSEMBLY COMPLETE,  NO ERRORS

LOC  OBJ        LINE        SOURCE STATEMENT

                  1
                  2 ;*********************************************************************
                  3 ;*                                                                   *
                  4 ;*     BELOIT CORPORATION ASSEMBLY LANGUAGE PROGRAM DOCUMENTATION    *
                  5 ;*                                                                   *
                  6 ;*     Title :        PULSE COUNTER INITIALIZATION                   *
                  7 ;*                                                                   *
                  8 ;*     Author :       David T. Ng                                    *
                  9 ;*                                                                   *
                 10 ;*     Date Written  : MAY 5,1983                                    *
                 11 ;*     Last Revision : -------                                       *
                 12 ;*                                                                   *
                 13 ;*     File Type : PROCEDURE PUBLIC                                  *
                 14 ;*                                                                   *
                 15 ;*     Description of Operation :                                    *
                 16 ;*                                                                   *
                 17 ;*     INITIALIZE COUNTER 0 TO FFFFH FOR DRUM PULSE COUNTDOWN        *
                 18 ;*                                                                   *
                 19 ;*     Calling Sequence :      CALL SETCT                            *
                 20 ;*                                                                   *
                 21 ;*     Definition of Formal Parameters : NONE                        *
                 22 ;*                                                                   *
                 23 ;*     Subroutines Called :    NONE                                  *
                 24 ;*                                                                   *
                 25 ;*     Registers Affected :    NONE                                  *
                 26 ;*                                                                   *
                 27 ;*     Revisions:      1) []                                         *
                 28 ;*                     2) []                                         *
                 29 ;*                     3) []                                         *
                 30 ;*                     4) []                                         *
                 31 ;*                                                                   *
                 32 ;*********************************************************************
                 33
                 34
                 35
                 36
                 37
                 38 $       TITLE('PULSE CNT. INT.')
```

```
LOC  OBJ        LINE     SOURCE STATEMENT

                 39       NAME FTCNT
                 40
0030             41       TOMO   EQU 030H
00DF             42       TMODE  EQU 0DFH
00DC             43       TO     EQU 0DCH
                 44       PUBLIC SETCT
                 45
                 46       CSEG
                 47
0000 3E30        48 SETCT: MVI A,TOMO      ;SETUP TIMER 0 MODE 0
0002 D3DF        49       OUT TMODE
0004 3EFF        50       MVI A,0FFH      ;INIT. TIMER0 LSB ,MSB TO FFH
0006 D3DC        51       OUT TO
0008 D3DC        52       OUT TO
000A C9          53       RET
                 54       END


PUBLIC SYMBOLS
SETCT  C 0000

EXTERNAL SYMBOLS


USER-SYMBOLS
SETCT  C 0000    TO     A 00DC    TOMO   A 0030    TMODE  A 00DF

ASSEMBLY COMPLETE,   NO ERRORS
```

```
LOC  OBJ        LINE      SOURCE STATEMENT

                   1
                   2 ;*********************************************************************
                   3 ;*                                                                   *
                   4 ;*      BELOIT CORPORATION ASSEMBLY LANGUAGE PROGRAM DOCUMENTATION   *
                   5 ;*                                                                   *
                   6 ;*      Title :         READ DRUM-PULSE COUNTER                      *
                   7 ;*                                                                   *
                   8 ;*      Author :        David T. Ns                                  *
                   9 ;*                                                                   *
                  10 ;*      Date Written  : MAY 5,1983                                   *
                  11 ;*      Last Revision : -------                                      *
                  12 ;*                                                                   *
                  13 ;*      File Type : PROCEDURE PUBLIC                                 *
                  14 ;*                                                                   *
                  15 ;*      Description of Operation :                                   *
                  16 ;*                                                                   *
                  17 ;*      READ COUNTER 0,LSB FIRST ,THEN MSB; 1'S COMPLEMENT THEN      *
                  18 ;*      STORE AT LOCATION OF ARGUMENT                                *
                  19 ;*                                                                   *
                  20 ;*      Callins Sequence :      CALL PCRD(.A)                        *
                  21 ;*                                                                   *
                  22 ;*      Definition of Formal Parameters : NONE                       *
                  23 ;*                                                                   *
                  24 ;*      Subroutines Called :    NONE                                 *
                  25 ;*                                                                   *
                  26 ;*      Registers Affected :    B,C,H,L                              *
                  27 ;*                                                                   *
                  28 ;*      Revisions:      1) []                                        *
                  29 ;*                      2) []                                        *
                  30 ;*                      3) []                                        *
                  31 ;*                      4) []                                        *
                  32 ;*                                                                   *
                  33 ;*********************************************************************
                  34
                  35
                  36
                  37
                  38
                  39 $      TITLE('READ DRUM PULSE CTR')
                  40        NAME DRUMCT
                  41
0000              42        LTO     EQU  00H
00DF              43        TMODE   EQU 0DFH
00DC              44        TO      EQU 0DCH
                  45        PUBLIC  PCRD
                  46        EXTRN  UDPCTR
                  47
                  48        CSEG
                  49
0000 3E00         50 PCRD:  MVI A,LTO
0002 D3DF         51        OUT TMODE
0004 DBDC         52        IN TO
0006 2F           53        CMA
0007 02           54        STAX B
```

```
LOC  OBJ        LINE      SOURCE STATEMENT

000B 03           55        INX B
0009 DBDC         56        IN TO
000B 2F           57        CMA
000C 02           58        STAX B
000D 03           59        INX B
000E 210000   E   60        LXI H,UDPCTR
0011 7E           61        MOV A,M
0012 2F           62        CMA
0013 02           63        STAX B
0014 03           64        INX B
0015 23           65        INX H
0016 7E           66        MOV A,M
0017 2F           67        CMA
001B 02           68        STAX B
0019 C9           69        RET
                  70
                  71        END


PUBLIC SYMBOLS
PCRD   C 0000

EXTERNAL SYMBOLS
UDPCTR E 0000

USER SYMBOLS
LTO    A 0000    PCRD   C 0000    TO     A 00DC    TMODE  A 00DF    UDPCTR E 0000

ASSEMBLY COMPLETE,   NO ERRORS
```

```
ISIS-II PL/M-80 V3.1 COMPILATION OF MODULE STPDIST
NO OBJECT MODULE REQUESTED
COMPILER INVOKED BY:  PLM80 :F1:FCSTPD.PLM NOOBJECT
```

- - --

```
/*********************************************************************/
/*                                                                   */
/*            BELOIT CORPORATION PLM PROGRAM DOCUMENTATION           */
/*                                                                   */
/*     Title :     STOPPING DISTANCE COMPUTATION                     */
/*                                                                   */
/*     Author :    David T. Ns                                       */
/*                                                                   */
/*     Date Written  : MAY 6,1983                                    */
/*     Last Revision : -------                                       */
/*                                                                   */
/*     File Type : PROCEDURE PUBLIC                                  */
/*                                                                   */
/*     Description of Operation :                                    */
/*                                                                   */
/*     COMPUTE SPEED AND STOPPING DISTANCE                           */
/*                                                                   */
/*     Calling Sequence :  CALL STOP$DISTANCE                        */
/*                                                                   */
/*     Definition of Formal Parameters : NONE                        */
/*                                                                   */
/*     Procedures Called : FSET,FLTDS,FZTST,FMUL,FDIV,FSTOR,FLOAD    */
/*                         FADD                                      */
/*                                                                   */
/*     Revisions :     1) []                                         */
/*                     2) []                                         */
/*                     3) []                                         */
/*                     4) []                                         */
/*                                                                   */
/*********************************************************************/
```

```
1          STPDIST:    /* FOLLOWING PROC. COMPUTE STOPDISTANCE */
               DO;

2   1      FSET:
               PROCEDURE (FA,OP1,OP2) EXTERNAL;
3   2          DECLARE (FA,OP1,OP2) ADDRESS;
4   2          END FSET;

5   1      FSTOR:
               PROCEDURE (FA,FB) EXTERNAL;
6   2          DECLARE (FA,FB) ADDRESS;
7   2          END FSTOR;

8   1      FMUL:
               PROCEDURE (FA,FB) EXTERNAL;
```

```
 9  2          DECLARE (FA,FB) ADDRESS;
10  2      END FMUL;

11  1   FDIV:
        PROCEDURE (FA,FB) EXTERNAL;
12  2          DECLARE (FA,FB) ADDRESS;
13  2      END FDIV;

14  1   FADD:
        PROCEDURE (FA,FB) EXTERNAL;
15  2          DECLARE (FA,FB) ADDRESS;
16  2      END FADD;

17  1   FLTDS:
        PROCEDURE (FA,FB) EXTERNAL;
18  2          DECLARE (FA,FB) ADDRESS;
19  2      END FLTDS;

20  1   FLOAD:
        PROCEDURE (FA,FB) EXTERNAL;
21  2          DECLARE (FA,FB) ADDRESS;
22  2      END FLOAD;

23  1   FZTST:
        PROCEDURE (FA) BYTE EXTERNAL;
24  2          DECLARE FA ADDRESS;
25  2      END FZTST;

26  1      DECLARE FSTOPD (4) BYTE EXTERNAL;
27  1      DECLARE FFTSC (4) BYTE EXTERNAL;
28  1      DECLARE FPR (18) BYTE EXTERNAL;
29  1      DECLARE FDELTAT (4) BYTE EXTERNAL;
30  1      DECLARE F2DECL (4) BYTE EXTERNAL;
31  1      DECLARE DRUM$CT (2) ADDRESS EXTERNAL;
32  1      DECLARE CUDRUMCT (2) ADDRESS EXTERNAL;
33  1      DECLARE LADRUMCT (2) ADDRESS EXTERNAL;
34  1      DECLARE FSPEED1 (4) BYTE PUBLIC;
35  1      DECLARE FSPEED2 (4) BYTE ;
36  1      DECLARE FNUM2 (4) BYTE EXTERNAL;
37  1      DECLARE FSPEED (4) BYTE PUBLIC;

38  1   STOP$DISTANCE:
        PROCEDURE PUBLIC;
39  2          DECLARE STAT BYTE;
40  2          DECLARE DELTACT (2) ADDRESS;
41  2          DELTACT(0) = CUDRUMCT(0) - LADRUMCT(0);
42  2          DELTACT(1) = CUDRUMCT(1) - LADRUMCT(1);

43  2          IF CUDRUMCT(0) ( LADRUMCT(0) THEN DELTACT(1) = DELTACT(1) -1;
45  2          CALL FSET(.FPR,0,0);
46  2          CALL FLTDS(.FPR,.DELTACT);
47  2          STAT = FZTST(.FPR);

48  2          IF (STAT AND 0C0H) ) 0 THEN
49  2              DO;
50  3                  CALL FMUL(.FPR,.FFTSC);
51  3                  CALL FDIV(.FPR,.FDELTAT);
```

```
52  3                CALL FSTOR(.FPR,.FSPEED2);
53  3             END;
54  2          ELSE CALL FLOAD(.FPR,.FSPEED1);

55  2          CALL FADD(.FPR,.FSPEED1);
56  2          CALL FDIV(.FPR,.FNUM2);
57  2          CALL FSTOR(.FPR,.FSPEED);
58  2          CALL FMUL(.FPR,.FSPEED);
59  2          CALL FDIV(.FPR,.F2DECL);
60  2          CALL FSTOR(.FPR,.FSTOPD);
61  2          CALL FLOAD(.FPR,.FSPEED2);
62  2          CALL FSTOR(.FPR,.FSPEED1);

63  2       END STOP$DISTANCE;
64  1       END STPDIST;


MODULE INFORMATION:

    CODE AREA SIZE     = 00C6H    198D
    VARIABLE AREA SIZE = 0011H     17D
    MAXIMUM STACK SIZE = 0004H      4D
    123 LINES READ
    0 PROGRAM ERROR(S)

END OF PL/M-80 COMPILATION
```

```
ISIS-II PL/M-80 V3.1 COMPILATION OF MODULE FOOTAGECONTROL
OBJECT MODULE PLACED IN :F1:FCDECL.OBJ
COMPILER INVOKED BY:  PLM80 :F1:FCDECL.PLM DEBUG

/*********************************************************************/
/*                                                                   */
/*            BELOIT CORPORATION PLM PROGRAM DOCUMENTATION           */
/*                                                                   */
/*     Title :     DECELERATION CONTROL                              */
/*                                                                   */
/*     Author :    David T. Ng                                       */
/*                                                                   */
/*     Date Written  : MAY 6,1983                                    */
/*                                                                   */
/*     Last Revision : -------                                       */
/*                                                                   */
/*     File Type : PROCEDURE PUBLIC                                  */
/*                                                                   */
/*     Description of Operation :                                    */
/*                                                                   */
/*     IF CURRENT FOOTAGE,OR CURRENT FOOTAGE PLUS STOPPING DISTANCE  */
/*     IS GREATER THAN TARGET FOOTAGE, THEN RAISE THE DECELERATION   */
/*     FLAG. ADD 'DEAD TIME' COMPENSATION IF IT IS THE FIRST TIME    */
/*     THROUGH DECELERATION LOOP.                                    */
/*                                                                   */
/*     Calling Sequence :  CALL DECELERATION                         */
/*                                                                   */
/*     Definition of Formal Parameters : NONE                        */
/*                                                                   */
/*     Procedures Called : FLOAD,FADD,FSUB,FCMPR,FMUL.               */
/*                                                                   */
/*     Revisions :     1) []                                         */
/*                     2) []                                         */
/*                     3) []                                         */
/*                     4) []                                         */
/*                                                                   */
/*********************************************************************/


1          FOOTAGE$CONTROL:
               DO;

2   1.           DECLARE FPR (18) BYTE EXTERNAL;

3   1      FLOAD:
                 PROCEDURE(FA,FB) EXTERNAL;
4   2                DECLARE (FA,FB) ADDRESS;
5   2            END FLOAD;
6   1      FADD:
                 PROCEDURE (FA,FB) EXTERNAL;
7   2                DECLARE (FA,FB) ADDRESS;
```

```
 8  2            END FADD;
 9  1     FSUB:
                 PROCEDURE (FA,FB) EXTERNAL;
10  2                DECLARE (FA,FB) ADDRESS;
11  2            END FSUB;
12  1     FCMPR:
                 PROCEDURE (FA,FB) BYTE EXTERNAL;
13  2                DECLARE (FA,FB) ADDRESS;
14  2            END FCMPR;
15  1     FMUL:
                 PROCEDURE (FA,FB) EXTERNAL;
16  2                DECLARE (FA,FB) ADDRESS;
17  2            END FMUL;


18  1            DECLARE FTOTFT (4) BYTE EXTERNAL;
19  1            DECLARE FTAR$FT (4) BYTE EXTERNAL;
20  1            DECLARE FSTOPD(4) BYTE EXTERNAL;
21  1            DECLARE FTAR$TOL (4) BYTE EXTERNAL;
22  1            DECLARE STAT1 BYTE;
23  1            DECLARE STAT2 BYTE;
24  1            DECLARE DEC$FLAG BYTE PUBLIC;
25  1            DECLARE FSPEED (4) BYTE EXTERNAL;
26  1            DECLARE TADV BYTE EXTERNAL;
27  1            DECLARE FNUM2 (4) BYTE EXTERNAL;
28  1            DECLARE F2DECL (4) BYTE EXTERNAL;

29  1     DECELERATION:
                 PROCEDURE PUBLIC;
30  2                CALL FLOAD(.FPR,.FTAR$FT);
31  2                CALL FSUB(.FPR,.FTOTFT);
32  2                STAT1=FCMPR(.FPR,.FTAR$TOL);
33  2                IF (STAT1 AND 0A0H)>0 THEN
34  2                    DO;
35  3                    DEC$FLAG = 00H;
36  3                    END;
37  2                ELSE DO;
38  3                    IF TADV = 00 THEN
39  3                        DO;
40  4                        CALL FLOAD(.FPR,.FSPEED);
41  4                        CALL FMUL(.FPR,.F2DECL);
42  4                        CALL FADD(.FPR,.FSTOPD);
43  4                        CALL FADD(.FPR,.FTOTFT);
44  4                        STAT2=FCMPR(.FPR,.FTAR$FT);
45  4                        END;
46  3                    ELSE DO;
47  4                        CALL FLOAD(.FPR,.FSTOPD);
48  4                        CALL FADD(.FPR,.FTOTFT);
49  4                        STAT2=FCMPR(.FPR,.FTAR$FT);
50  4                        END;
51  3                END;
52  2                IF(STAT2 AND 0C0H)>0 THEN
53  2                    DO;
54  3                    DEC$FLAG = 00H;
55  3                    TADV = 01H;
56  3                    END;
57  2                ELSE DEC$FLAG = 01H;
```

```
58   2              OUTPUT(0E8H)=NOT(DEC$FLAG);
59   2            END DECELERATION;
60   1         END FOOTAGE$CONTROL;
```

```
MODULE INFORMATION:

    CODE AREA SIZE     = 0080H    1760
    VARIABLE AREA SIZE = 0003H      3D
    MAXIMUM STACK SIZE = 0002H      2D
    114 LINES READ
    0 PROGRAM ERROR(S)

END OF PL/M-80 COMPILATION
```

```
ISIS-II PL/M-80 V3.1 COMPILATION OF MODULE DISPLAY
OBJECT MODULE PLACED IN :F1:DISPLY.OBJ
COMPILER INVOKED BY:  PLM80 :F1:DISPLY.PLM DEBUG
```

```
/*********************************************************************/
/*                                                                   */
/*            BELOIT CORPORATION PLM PROGRAM DOCUMENTATION           */
/*                                                                   */
/*     Title :     DISPLAY FOOTAGE & ROLL DIAMETER                   */
/*                                                                   */
/*     Author :    David T. Ng                                       */
/*                                                                   */
/*     Date Written  : MAY 6, 1983                                   */
/*     Last Revision : -------                                       */
/*                                                                   */
/*     File Type : PROCEDURE PUBLIC                                  */
/*                                                                   */
/*     Description of Operation :                                    */
/*                                                                   */
/*     COMPUTE ROLL DIAMETER & TOTAL FOOTAGE,DO 17 BIT BINARY TO 5   */
/*     DIGITS BCD CONVERSION, COMPENSATE FOR LAYERS SLABBED OFF,     */
/*     DISPLAY DATAE TO LED DISPLAY.                                 */
/*                                                                   */
/*     Calling Sequence :  CALL DATADISPLAY                          */
/*                                                                   */
/*     Definition of Formal Parameters : NONE                        */
/*                                                                   */
/*     Procedures Called : FMUL,FLTDS,FIXSD,FSTOR,FLOAD,FSUB,FDIV    */
/*     FCMPR.                                                        */
/*                                                                   */
/*     Revisions :     1) []                                         */
/*                     2) []                                         */
/*                     3) []                                         */
/*                     4) []                                         */
/*                                                                   */
/*********************************************************************/
```

```
1          DISPLAY:
               DO;

2   1      FMUL:
               PROCEDURE(FA,FB) EXTERNAL;
3   2          DECLARE (FA,FB) ADDRESS;
4   2          END FMUL;

5   1      FLTDS:
               PROCEDURE (FA,FB) EXTERNAL;
6   2          DECLARE (FA,FB) ADDRESS;
7   2          END FLTDS;

8   1      FIXSD:
               PROCEDURE (FA,FB) EXTERNAL;
9   2          DECLARE (FA,FB) ADDRESS;
10  2          END FIXSD;

11  1      FSTOR:
               PROCEDURE (FA,FB) EXTERNAL;
12  2          DECLARE (FA,FB) ADDRESS;
13  2          END FSTOR;

14  1      FLOAD:
               PROCEDURE (FA,FB) EXTERNAL;
15  2          DECLARE (FA,FB) ADDRESS;
16  2          END FLOAD;

17  1      FSUB:
               PROCEDURE (FA,FB) EXTERNAL;
18  2          DECLARE (FA,FB) ADDRESS;
19  2          END FSUB;

20  1      FDIV:
               PROCEDURE (FA,FB) EXTERNAL;
21  2          DECLARE (FA,FB) ADDRESS;
22  2          END FDIV;

23  1      FCMPR:
               PROCEDURE (FA,FB) BYTE EXTERNAL;
24  2          DECLARE (FA,FB) ADDRESS;
25  2          END FCMPR;


                   /* 17 BIT BINARY TO 5 DIGITS BCD CONVERSION
26  1      BI$BCD:
               PROCEDURE(IBIN$PTR,BCD$PTR)PUBLIC;
27  2          DECLARE BCD$PTR ADDRESS;
28  2          DECLARE IBIN$PTR ADDRESS;
29  2          DECLARE IBIN BASED IBIN$PTR (4) BYTE;
30  2          DECLARE BIN$NUM BASED IBIN$PTR (2) ADDRESS;
31  2          DECLARE BCD$NUM BASED BCD$PTR (5) BYTE;
32  2          DECLARE CARRYUNDER ADDRESS;
33  2          DECLARE BCDADJ BYTE;
34  2          DECLARE BIN$QUO ADDRESS;
35  2          DECLARE X BYTE;
```

```
36  2          IF BIN$NUM(1))=1 THEN
37  2              DO;
38  3              CARRYUNDER=1999H;
39  3              BCDADJ=6H;
40  3              END;
41  2          ELSE DO;
42  3              CARRYUNDER=0H;
43  3              BCDADJ=0H;
44  3              END;

45  2          BCD$NUM(0)=LOW(BIN$NUM(0)MOD 10)+BCDADJ;
46  2          BIN$QUO=(BIN$NUM(0)/10)+CARRYUNDER;
47  2          DO X=1 TO 4;
48  3          BCD$NUM(X)=LOW(BIN$QUO MOD 10);
49  3          BIN$QUO=BIN$QUO/10;
50  3          END;

51  2          DO X=0 TO 4;
52  3          IF BCD$NUM(X))=10 THEN
53  3              DO;
54  4              BCD$NUM(X)=BCD$NUM(X)-10;
55  4              BCD$NUM(X+1)=BCD$NUM(X+1)+1;
56  4              END;
57  3          END;
58  2      END BI$BCD;

               /* REPACK & DISPLAY DATAE */
59  1      DECLARE BCDD(5) BYTE EXTERNAL;
60  1      DECLARE BCDL(5) BYTE EXTERNAL;

61  1   DISPLY:
           PROCEDURE PUBLIC;
62  2          DECLARE DISPLYD(2) BYTE;
63  2          DECLARE DISPLYL(3) BYTE;

64  2          DISPLYD(0)=(SHL(BCDD(1),4)) OR BCDD(0);
65  2          DISPLYD(1)=BCDD(2);
66  2          DISPLYL(0)=(SHL(BCDL(1),4)) OR BCDL(0);
67  2          DISPLYL(1)=(SHL(BCDL(3),4)) OR BCDL(2);
68  2          DISPLYL(2)=BCDL(4);
69  2          OUTPUT(0E5H)=DISPLYD(0);
70  2          OUTPUT(0EAH)=1EH;
71  2          OUTPUT(0EAH)=1FH;
72  2          OUTPUT(0E5H)=DISPLYD(1);
73  2          OUTPUT(0EAH)=1DH;
74  2          OUTPUT(0EAH)=1FH;
75  2          OUTPUT(0E5H)=DISPLYL(0);
76  2          OUTPUT(0EAH)=1BH;
77  2          OUTPUT(0EAH)=1FH;
78  2          OUTPUT(0E5H)=DISPLYL(1);
79  2          OUTPUT(0EAH)=17H;
80  2          OUTPUT(0EAH)=1FH;
81  2          OUTPUT(0E5H)=DISPLYL(2);
82  2          OUTPUT(0EAH)=0FH;
83  2          OUTPUT(0EAH)=1FH;
84  2      END DISPLY;
```

```
                /* SLABBED OFF COMPENSATION */
 85  1          DECLARE LFROL (4) BYTE EXTERNAL;
 86  1          DECLARE FADJSL (4) BYTE PUBLIC DATA(55H,55H,55H,3DH);/*  5/96*/
 87  1          DECLARE FCALIP (4) BYTE EXTERNAL;
 88  1          DECLARE CTADJ (2) ADDRESS;
 89  1          DECLARE UDPCTR ADDRESS EXTERNAL;
 90  1          DECLARE FROLD2 (4) BYTE;

 91  1      LENADJ:
             PROCEDURE PUBLIC;
 92  2           DECLARE I BYTE;
 93  2           DECLARE DCT$TEMP (2) ADDRESS;
 94  2           CALL FLOAD(.FPR,.FROLD);
 95  2           CALL FMUL(.FPR,.FROLD);
 96  2           CALL FSTOR(.FPR,.FROLD2);
 97  2           CALL FLOAD(.FPR,.LFROL);
 98  2           CALL FMUL(.FPR,.LFROL);
 99  2           CALL FSUB(.FPR,.FROLD2);
100  2           CALL FMUL(.FPR,.FADJSL);
101  2           CALL FDIV(.FPR,.FCALIP);
102  2           CALL FIXSD(.FPR,.CTADJ);

103  2           IF CTADJ(1) AND 0080H = 0080H THEN GO TO CLRFG;
105  2           IF CTADJ(1) ) DRUMCT(1) THEN GO TO CLRFG;
107  2           DCT$TEMP(0) = DRUMCT(0) -CTADJ(0);
108  2           DCT$TEMP(1) = DRUMCT(1) -CTADJ(1);
109  2           IF DRUMCT(0) ( CTADJ(0) THEN DCT$TEMP(1) = DCT$TEMP(1) - 1;
111  2           DO I = 0 TO 1;
112  3           DRUMCT(I) = DCT$TEMP(I);
113  3           END;
114  2           OUTPUT(0DFH) = 30H;
115  2           OUTPUT(0DCH) = LOW(NOT(DRUMCT(0)));
116  2           OUTPUT(0DCH) = HIGH(NOT(DRUMCT(0)));
117  2           UDPCTR = NOT(DRUMCT(1));
118  2      CLRFG:  LENADJ$FLAG = 00H;
119  2         END LENADJ;

                /* COMPUTE ROLL DIAMETER & FOOTAGE */
120  1          DECLARE FRDSC(4) BYTE EXTERNAL;
121  1          DECLARE PULSEC(2) ADDRESS EXTERNAL;
122  1          DECLARE FTOTFT(4) BYTE PUBLIC;
123  1          DECLARE FFTSC(4) BYTE EXTERNAL;
124  1          DECLARE DRUM$CT(2) ADDRESS EXTERNAL;
125  1          DECLARE FPR(18) BYTE EXTERNAL;
126  1          DECLARE CURPUSCT(2) ADDRESS EXTERNAL;
127  1          DECLARE LASPUSCT(2) ADDRESS EXTERNAL;
128  1          DECLARE SHBR$FLAG BYTE EXTERNAL;
129  1          DECLARE LENADJ$FLAG BYTE EXTERNAL;
130  1          DECLARE FROLD (4) BYTE PUBLIC;

131  1      DATADISPLAY:
             PROCEDURE PUBLIC;
132  2           DECLARE INCPUSCT(2) ADDRESS;
133  2           DECLARE IROLD(2) ADDRESS;
134  2           DECLARE ITOTFT(2) ADDRESS;
135  2           DECLARE STAT BYTE;
```

```
136  2          INCPUSCT(0)=CURPUSCT(0)-LASPUSCT(0);
137  2          INCPUSCT(1)=CURPUSCT(1)-LASPUSCT(1);
138  2          IF CURPUSCT(0)<LASPUSCT(0) THEN INCPUSCT(1)=INCPUSCT(1)-1;
140  2          CALL FLTDS(.FPR,.INCPUSCT);
141  2          CALL FMUL(.FPR,.FRDSC);
142  2          CALL FSTOR(.FPR,.FROLD);
143  2          CALL FIXSD(.FPR,.IROLD);

144  2          IF LENADJ$FLAG = 01H THEN
145  2              DO;
146  3              CALL LENADJ;
147  3              SHBR$FLAG = 00H;
148  3              END;

149  2          CALL FLTDS(.FPR,.DRUM$CT);
150  2          CALL FMUL(.FPR,.FFTSC);
151  2          CALL FSTOR(.FPR,.FTOTFT);
152  2          CALL FIXSD(.FPR,.ITOTFT);
153  2          CALL BI$BCD(.IROLD,.BCDD);
154  2          CALL BI$BCD(.ITOTFT,.BCDL);
155  2          CALL DISPLY;
156  2        END DATADISPLAY;
157  1        END DISPLAY;
```

MODULE INFORMATION:

```
    CODE AREA SIZE     = 02DAH    730D
    VARIABLE AREA SIZE = 0031H     49D
    MAXIMUM STACK SIZE = 0006H      6D
    235 LINES READ
    0 PROGRAM ERROR(S)

END OF PL/M-80 COMPILATION
```

```
$EJECT
/*************************************************************************/
/*                                                                       */
/*            BELOIT CORPORATION*PLM PROGRAM DOCUMENTATION               */
/*                                                                       */
/*     Title :     INTERRUPT ROUTINES                                    */
/*                                                                       */
/*     Author :    David T. Ng                                           */
/*                                                                       */
/*     Date Written  : MAY 5, 1983                                       */
/*     Last Revision : -------                                           */
/*                                                                       */
/*     File Type : PROCEDURE INTERRUPT                                   */
/*                                                                       */
/*     Description of Operation :                                        */
/*                                                                       */
/*     PROCEDURE INTERRUPT 1 INVOKED BY ROLL-TACH PULSE                  */
/*     PROCEDURE INTERRUPT 2 IS THE SAMPLING EVERY .5 SEC                */
/*     PROCEDURE INTERRUPT 3 IS THE UPPER 16 BIT SOFTWARE CTR.           */
/*     PROCEDURE INTERRUPT 4 IS THE SHEETBREAK FLAG SET                  */
/*     PROCEDURE INTERRUPT 5 IS THE RESTART                              */
/*                                                                       */
/*     Callins Sequence :  NONE                                          */
/*                                                                       */
/*     Definition of Formal Parameters : NONE                            */
/*                                                                       */
/*     Procedures Called : PCRD(.A),SETR,SETCT                           */
/*                                                                       */
/*     Revisions :     1) []                                             */
/*                     2) []                                             */
/*                     3) []                                             */
/*                     4) []                                             */
/*                                                                       */
/*************************************************************************/


1          ITRPT:
              DO;

2   1      PCRD:
                PROCEDURE (A) EXTERNAL;
3   2              DECLARE A ADDRESS;
4   2           END PCRD;

5   1      SETR:
                PROCEDURE EXTERNAL;
6   2              END SETR;

7   1      SETCT:
                PROCEDURE EXTERNAL;
8   2              END SETCT;

9   1           DECLARE DRUM$CT (2) ADDRESS EXTERNAL;
10  1           DECLARE INIT$CNT BYTE EXTERNAL;
```

```
11  1          DECLARE PULSEC (2) ADDRESS EXTERNAL;
12  1          DECLARE CUDRUMCT (2) ADDRESS EXTERNAL;
13  1          DECLARE LASPUSCT (2) ADDRESS EXTERNAL;
14  1          DECLARE LAYER$CTR BYTE EXTERNAL;
15  1          DECLARE LADRUMCT (2) ADDRESS EXTERNAL;
16  1          DECLARE CURPUSCT (2) ADDRESS EXTERNAL;
17  1          DECLARE UDPCTR ADDRESS EXTERNAL;
18  1          DECLARE DEC$FLAG BYTE EXTERNAL;
19  1          DECLARE FROLD (4) BYTE EXTERNAL;
20  1          DECLARE SHBR$FLAG BYTE EXTERNAL;
21  1          DECLARE LFROL (4) BYTE PUBLIC;
22  1          DECLARE LENADJ$FLAG BYTE EXTERNAL;

23  1     RPITR:
                PROCEDURE INTERRUPT 1;
24  2              DECLARE I BYTE;
25  2              LAYER$CTR = LAYER$CTR - 1;
26  2              IF LAYER$CTR = 0 THEN
27  2                  DO;
28  3                  OUTPUT(0EBH) = NOT(02H OR DEC$FLAG);
29  3                  LAYER$CTR = INIT$CNT;
30  3                  OUTPUT(0EBH) = NOT(00H OR DEC$FLAG);
31  3                  END;
32  2              DO I = 0 TO 1;
33  3              LASPUSCT(I) = PULSEC(I);
34  3              END;
35  2              CALL PCRD(.PULSEC);
36  2              DO I = 0 TO 1;
37  3              CURPUSCT(I) = PULSEC(I);
38  3              END;
39  2              IF SHBR$FLAG > 1 THEN SHBR$FLAG = SHBR$FLAG - 1;
41  2              IF SHBR$FLAG = 1 THEN LENADJ$FLAG = 1;
43  2              OUTPUT(0DBH) = 20H;        /* EOI TO RESET ISR */
44  2           END RPITR;

45  1     SRITR:
                PROCEDURE INTERRUPT 2;
46  2              DECLARE I BYTE;
47  2              CALL SETR;
48  2              DO I = 0 TO 1;
49  3              LADRUMCT(I) = DRUM$CT(I);
50  3              END;
51  2              CALL PCRD(.DRUM$CT);
52  2              DO I = 0 TO 1;
53  3              CUDRUMCT(I) = DRUM$CT(I);
54  3              END;
55  2              OUTPUT(0DBH) = 20H;        /* EOI TO RESET ISR */
56  2           END SRITR;

57  1     DPITR:
                PROCEDURE INTERRUPT 3;
58  2              CALL SETCT;
59  2              UDPCTR = UDPCTR - 1;
60  2              OUTPUT(0DBH) = 20H;        /* EOI TO RESET ISR */
61  2           END DPITR;

62  1     SHTBR:
```

```
                    PROCEDURE INTERRUPT 4;
63  2                   DECLARE I BYTE;
64  2                   DO I = 0 TO 3;
65  3                   LFROL(I) = FROLD(I);
66  3                   END;
67  2                   SHBR$FLAG = 03H;
68  2                   OUTPUT(0D8H) = 20H;        /* EOI TO RESET ISR */
69  2               END SHTBR;

70  1       RESET:
                    PROCEDURE INTERRUPT 5;
71  2                   DECLARE RESTART ADDRESS AT(1);
72  2                   DISABLE;
73  2                   CALL RESTART;
74  2               END RESET;

75  1       FIX:
                    PROCEDURE INTERRUPT 7;
76  2                   OUTPUT(0D8H) = 20H;
77  2               END FIX;

78  1       END;


MODULE INFORMATION:

    CODE AREA SIZE     = 01A2H    418D
    VARIABLE AREA SIZE = 0007H      7D
    MAXIMUM STACK SIZE = 000AH     10D
    137 LINES READ
    0 PROGRAM ERROR(S)

END OF PL/M-80 COMPILATION


ISIS-II PL/M-80 V3.1 COMPILATION OF MODULE ITRPT
OBJECT MODULE PLACED IN :F1:FCITR.OBJ
COMPILER INVOKED BY:  PLM80 :F1:FCITR.PLM DEBUG
```

```
ISIS-II PL/M-80 V3.1 COMPILATION OF MODULE MAINMOD
OBJECT MODULE PLACED IN :F2:FMAIND.OBJ
COMPILER INVOKED BY:  PLM80 :F2:FMAIND.PLM DEBUG


          /*********************************************************************/
          /*                                                                   */
          /*            BELOIT CORPORATION PLM PROGRAM DOCUMENTATION           */
          /*                                                                   */
          /*     Title :     MAIN DIAMETER CONTROL PROGRAM                     */
          /*                                                                   */
          /*     Author :    David T. Ng                                       */
          /*                                                                   */
          /*     Date Written  : MAY 11, 1983                                  */
          /*     Last Revision : -------                                       */
          /*                                                                   */
          /*     File Type : PROCEDURE MAIN                                    */
          /*                                                                   */
          /*     Description of Operation :                                    */
          /*                                                                   */
          /*     THIS IS THE MAIN PROGRAM OF THE STOP TO DIAMETER COMPUTER,    */
          /*     CALLING THE VARIOUS FUNCTIONAL MODULES.                       */
          /*                                                                   */
          /*     Calling Sequence :  NONE                                      */
          /*                                                                   */
          /*     Definition of Formal Parameters : NONE                        */
          /*                                                                   */
          /*     Procedures Called : IOINT,PICINT,SETR,PCRD(.A),               */
          /*                         READ4SETPOINTS,DECLERATION,STOP$DISTANCE  */
          /*                         DATADISPLAY.                              */
          /*                                                                   */
          /*     Revisions :     1) []                                         */
          /*                     2) []                                         */
          /*                     3) []                                         */
          /*                     4) []                                         */
          /*                                                                   */
          /*********************************************************************/


1         MAINMOD:    /* MAIN FOOTAGE CONTROL PROGRAM */
             DO;

2   1     PCRD:
             PROCEDURE (A) EXTERNAL;
3   2           DECLARE A ADDRESS;
4   2        END PCRD;

5   1     SETCT:
             PROCEDURE EXTERNAL;
6   2        END SETCT;

7   1     SETR:
             PROCEDURE EXTERNAL;
8   2        END SETR;
```

```
 9  1     READ$SETPOINTS:
              PROCEDURE EXTERNAL;
10  2         END READ$SETPOINTS;

11  1     IOINT:
              PROCEDURE EXTERNAL;
12  2         END IOINT;

13  1     PICINT:
              PROCEDURE EXTERNAL;
14  2         END PICINT;

15  1     STOP$DISTANCE:
              PROCEDURE EXTERNAL;
16  2         END STOP$DISTANCE;

17  1     DECELERATION:
              PROCEDURE EXTERNAL;
18  2         END DECELERATION;

19  1     DATADISPLAY:
              PROCEDURE EXTERNAL;
20  2         END DATADISPLAY;

21  1     FSET:
              PROCEDURE(FA,OP1,OP2) EXTERNAL;
22  2             DECLARE (FA,OP1,OP2) ADDRESS;
23  2         END FSET;

24  1     FSTOR:
              PROCEDURE (FA,FB) EXTERNAL;
25  2             DECLARE (FA,FB) ADDRESS;
26  2         END FSTOR;

27  1     FMUL:
              PROCEDURE (FA,FB) EXTERNAL;
28  2             DECLARE (FA,FB) ADDRESS;
29  2         END FMUL;

30  1     FDIV:
              PROCEDURE (FA,FB) EXTERNAL;
31  2             DECLARE (FA,FB) ADDRESS;
32  2         END FDIV;

33  1     FLTDS:
              PROCEDURE (FA,FB) EXTERNAL;
34  2             DECLARE (FA,FB) ADDRESS;
35  2         END FLTDS;

36  1         DECLARE DRUM$CT (2) ADDRESS PUBLIC;
37  1         DECLARE PULSEC (4) BYTE PUBLIC;
38  1         DECLARE INIT$CNT BYTE PUBLIC DATA(0C8H);
39  1         DECLARE FDIA$TOL (4) BYTE PUBLIC DATA(0,0,00H,00H); /* TOL.= 0' */
40  1         DECLARE FDELTAT (4) BYTE PUBLIC DATA(0D0H,0B3H,0F9H,3EH);  /* TIME = 487.7 M    SEC */
41  1         DECLARE F2DECL (4) BYTE PUBLIC DATA(00H,00H,80H,40H); /* DE. = 2.0/S2 */
42  1         DECLARE FNUM2 (4) BYTE PUBLIC DATA(0,0,0,40H); /* NUM. TWO */
```

```
43  1        DECLARE FK (4) BYTE PUBLIC DATA(50H,76H,74H,41H);/* 48/PI */
44  1        DECLARE FCALIP (4) BYTE PUBLIC DATA(00H,0EH,3EH,3BH); /* CAL.=.0029" */
45  1        DECLARE LAYER$CTR BYTE PUBLIC;
46  1        DECLARE FPR (18) BYTE PUBLIC;
47  1        DECLARE FTARDIA (4) BYTE PUBLIC;
48  1        DECLARE FSTOPD (4) BYTE PUBLIC;
49  1        DECLARE BCDD (5) BYTE PUBLIC;
50  1        DECLARE BCDL (5) BYTE PUBLIC;
51  1        DECLARE FRDSC (4) BYTE PUBLIC;
52  1        DECLARE FFTSC (4) BYTE PUBLIC;
53  1        DECLARE CUDRUMCT (2) ADDRESS PUBLIC;
54  1        DECLARE LADRUMCT (2) ADDRESS PUBLIC;
55  1        DECLARE CURPUSCT (2) ADDRESS PUBLIC;
56  1        DECLARE LASPUSCT (2) ADDRESS PUBLIC;
57  1        DECLARE UDPCTR ADDRESS PUBLIC;
58  1        DECLARE I BYTE;
59  1        DECLARE LENADJ$FLAG BYTE PUBLIC;
60  1        DECLARE SHBR$FLAG BYTE PUBLIC;
61  1        DECLARE INIT$ROLCNT BYTE PUBLIC;

62  1     MAIN:  LAYER$CTR = INIT$CNT;
63  1            UDPCTR = 0FFFFH;
64  1            LENADJ$FLAG = 00H;
65  1            SHBR$FLAG = 00H;
66  1            INIT$ROLCNT = 05H;

67  1            CALL IOINT;
68  1            CALL PICINT;
69  1            CALL READ$SETPOINTS;
70  1            CALL SETR;
71  1            CALL SETCT;
72  1            CALL PCRD(.DRUM$CT);
73  1            CALL PCRD(.PULSEC);

74  1            DO I = 0 TO 1;
75  2               LASPUSCT(I) = PULSEC(I);
76  2            END;

                 /* MAIN CONTROL LOOP */
77  1     LOOP:  CALL STOP$DISTANCE;
78  1            CALL DECELERATION;
79  1            CALL DATADISPLAY;
80  1            GO TO LOOP;

81  1        END MAINMOD;


MODULE INFORMATION:

   CODE AREA SIZE     = 008BH    139D
   VARIABLE AREA SIZE = 004BH     75D
   MAXIMUM STACK SIZE = 0002H      2D
   155 LINES READ
   0 PROGRAM ERROR(S)

END OF PL/M-80 COMPILATION
```

```
ISIS-II PL/M-80 V3.1 COMPILATION OF MODULE FOOTAGECONTROL
OBJECT MODULE PLACED IN :F1:FCDECD.OBJ
COMPILER INVOKED BY:  PLM80 :F1:FCDECD.PLM DEBUG
```

```
/*****************************************************************/
/*                                                               */
/*          BELOIT CORPORATION PLM PROGRAM DOCUMENTATION         */
/*                                                               */
/*     Title :    DECELERATION CONTROL- DIAMETER BASED          */
/*                                                               */
/*     Author :   David T. Ng                                    */
/*                                                               */
/*     Date Written  : MAY 11,1983                               */
/*     Last Revision : -------                                   */
/*                                                               */
/*     File Type : PROCEDURE PUBLIC                              */
/*                                                               */
/*     Description of Operation :                                */
/*                                                               */
/*     IF CURRENT DIAMETER, OR CURRENT DIAMETER PLUS STOPPING    */
/*     THICKNESS IS GREATER THAN TARGET DIAMETER, THEN RAISE     */
/*     THE DECELERATION FLAG.                                    */
/*                                                               */
/*     Calling Sequence :  CALL DECELERATION                     */
/*                                                               */
/*     Definition of Formal Parameters : NONE                    */
/*                                                               */
/*     Procedures Called : FLOAD,FADD,FSUB,FMUL,FDIV,FCMPR,      */
/*     FSTOR,FSQRT.                                              */
/*                                                               */
/*     Revisions :     1) []                                     */
/*                     2) []                                     */
/*                     3) []                                     */
/*                     4) []                                     */
/*                                                               */
/*****************************************************************/
```

```
1          FOOTAGE$CONTROL:
               DO;

2   1          DECLARE FPR (18) BYTE EXTERNAL;

3   1      FLOAD:
               PROCEDURE(FA,FB) EXTERNAL;
4   2              DECLARE (FA,FB) ADDRESS;
5   2          END FLOAD;
6   1      FADD:
               PROCEDURE (FA,FB) EXTERNAL;
7   2              DECLARE (FA,FB) ADDRESS;
8   2          END FADD;
```

```
 9  1     FSUB:
                 PROCEDURE (FA,FB) EXTERNAL;
10  2               DECLARE (FA,FB) ADDRESS;
11  2            END FSUB;
12  1     FMUL:
                 PROCEDURE (FA,FB) EXTERNAL;
13  2               DECLARE (FA,FB) ADDRESS;
14  2            END FMUL;
15  1     FDIV:
                 PROCEDURE (FA,FB) EXTERNAL;
16  2               DECLARE (FA,FB) ADDRESS;
17  2            END FDIV;
18  1     FCMPR:
                 PROCEDURE (FA,FB) BYTE EXTERNAL;
19  2               DECLARE (FA,FB) ADDRESS;
20  2            END FCMPR;
21  1     FSTOR:
                 PROCEDURE (FA,FB) EXTERNAL;
22  2               DECLARE (FA,FB) ADDRESS;
23  2            END FSTOR;
24  1     FSQRT:
                 PROCEDURE (FA) EXTERNAL;
25  2               DECLARE FA ADDRESS;
26  2            END FSQRT;


27  1            DECLARE FDIATOL(4) BYTE EXTERNAL;
28  1            DECLARE FK(4) BYTE EXTERNAL;
29  1            DECLARE FCALIP(4) BYTE EXTERNAL;
30  1            DECLARE FSTOPD(4) BYTE EXTERNAL;
31  1            DECLARE FROLD(4) BYTE EXTERNAL;
32  1            DECLARE FTARDIA(4) BYTE EXTERNAL;
33  1            DECLARE FROLD2(4) BYTE;
34  1            DECLARE FSTFDIA(4) BYTE;
35  1            DECLARE STAT1 BYTE;
36  1            DECLARE STAT2 BYTE;
37  1            DECLARE DEC$FLAG BYTE PUBLIC;
38  1            DECLARE F10  (4) BYTE DATA(0,0, 20H,41H
39  1            DECLARE FROLD1 (4) BYTE ;
40  1            DECLARE INIT$ROLCNT BYTE EXTERNAL;

41  1     DECELERATION:
             PROCEDURE PUBLIC;

42  2            IF INIT$ROLCNT > 1 THEN
43  2               DO;
44  3               DEC$FLAG = 01H;
45  3               GO TO FINI;
46  3               END;
47  2            CALL FLOAD(.FPR,.FROLD);
48  2            CALL FDIV(.FPR,.F10);
49  2            CALL FSTOR(.FPR,.FROLD1);
50  2            CALL FMUL(.FPR,.FROLD1);
51  2            CALL FSTOR(.FPR,.FROLD2);
52  2            CALL FLOAD(.FPR,.FK);
53  2            CALL FMUL(.FPR,.FCALIP);
54  2            CALL FMUL(.FPR,.FSTOPD);
```

```
55  2            CALL FADD(.FPR,.FROLD2);
56  2            CALL FSQRT(.FPR);
57  2            CALL FSTOR(.FPR,.FSTPDIA);
58  2            STAT2=FCMPR(.FPR,.FTARDIA);

59  2            IF(STAT2 AND 0C0H)>0 THEN DEC$FLAG=00H;
61  2            ELSE DEC$FLAG=01H;

62  2            CALL FLOAD(.FPR,.FTARDIA);
63  2            CALL FSUB(.FPR,.FROLD1);
64  2            STAT1=FCMPR(.FPR,.FDIATOL);

65  2            IF(STAT1 AND 0A0H)>0 THEN DEC$FLAG=00H;

67  2      FINI:   OUTPUT(0E8H)=NOT(DEC$FLAG);
68  2         END DECELERATION;

69  1         END FOOTAGE$CONTROL;
```

```
MODULE INFORMATION:

    CODE AREA SIZE     = 00D0H    208D
    VARIABLE AREA SIZE = 000FH     15D
    MAXIMUM STACK SIZE = 0002H      2D
    127 LINES READ
    0 PROGRAM ERROR(S)

END OF PL/M-80 COMPILATION
```

```
[illegible]-11.OBJECT LINKER V3.0 INVOKED BY:
-LINK :F1:FCMAIN.OBJ,:F1:FCIOI.OBJ,:F[illegible]INT.OBJ,:F1:FCRTI.OBJ,:F1:FCPCI.OBJ,&
$,:F1:FCFFCRD.OBJ,:F1:FCSTPD.OBJ,:F1:FCDECL.OBJ,:F1:DISPLY.OBJ,:F0:FPAL.LIB,&
**:F0:PLM80.LIB,:F1:FCITR.OBJ TO :F1:FCMAIN.LNK MAP PRINT(:LP:)

[illegible] MAP OF MODULE FCMAIN
[illegible]ITEN TO FILE :F1:FCMAIN.LNK
MODULE IS A MAIN MODULE

[illegible]MENT INFORMATION:
START   STOP LENGTH REL NAME

            [illegible]6H  S  CODE
              [illegible]5H  S  DATA
              [illegible]7H  S  STACK
[illegible]06H  [illegible]0AH    3H  A  ABSOLUTE
[illegible]1[illegible]H  [illegible]012H    3H  A  ABSOLUTE
[illegible]12[illegible]  [illegible]01AH    3H  A  ABSOLUTE
[illegible]1[illegible]H  [illegible]02[illegible]H    3H  A  ABSOLUTE
[illegible]2[illegible]H  [illegible]02[illegible]H    3H  A  ABSOLUTE
[illegible]3[illegible]H  [illegible]03AH    3H  A  ABSOLUTE

INPUT MODULES INCLUDED:
 (F1:FCMAIN.OBJ(MAINMOD)
```

```
:F1:FCICI.OBJ(DEFID)
:F1:FCCINT.OBJ(INIT)
:F1:FCRTI.OBJ(SAMPLE)
:F1:FCTCI.OBJ(FTCNT)
 :F1:FCRB.OBJ(FRUMCT)
 :F1:FCFB.OBJ(FFDIST)
 :F1:FCDECL.OBJ(FOOTADJCONTROL)
 :F1:DISPLY.OBJ(DISPLAY)
:F0:FPAL.LIB(FADD)
:F0:FPAL.LIB(FCMPR)
:F0:FPAL.LIB(FDFD23)
:F0:FPAL.LIB(FDIV)
:F0:FPAL.LIB(FIXSD)
:F0:FPAL.LIB(FLOAD)
:F0:FPAL.LIB(FLTDS)
:F0:FPAL.LIB(FMUL)
:F0:FPAL.LIB(FSET)
:F0:FPAL.LIB(FSTOR)
 :F0:FPAL.LIB(FCHECK)
 :F0:FPAL.LIB(FCLR)
 :F0:FPAL.LIB(FEFOUND)
:F0:FPAL.LIB(FNEG)
:F0:FPAL.LIB(@MPLY)
:F0:FPAL.LIB(@NORML)
:F0:FPAL.LIB(FQFT10)
:F0:FPAL.LIB(FQFX10)
:F0:FPAL.LIB(@FOUND)
:F0:FPAL.LIB(@SHIFT)
:F0:PLM80.LIB(@P0011)
:F0:PLM80.LIB(@P0014)
:F0:PLM80.LIB(@P0025)
:F0:PLM80.LIB(@P0029)
:F0:PLM80.LIB(@P0036)
:F0:PLM80.LIB(@P0045)
:F0:PLM80.LIB(@P0091)
:F0:PLM80.LIB(@P0094)
:F0:PLM80.LIB(@P0101)
:F0:PLM80.LIB(@P0103)
:F1:FCITR.OBJ(ITRFT)
```

```
 0041H SYM  FTARTCL
 0045H SYM  FDELTAT
 0047H SYM  FCTECL
 004DH SYM  FNUMD
 0051H SYM  FCHLIP
 F008H SYM  LAYERCTR
 F009H SYM  FFF
 F01BH SYM  FTARFT
 F01FH SYM  FSTOFD
 F023H SYM  BCDS
 F028H SYM  BCDL
 F02DH SYM  FRBSC
 F031H SYM  FFTSC
 F035H SYM  CUIRUMCT
 F037H SYM  LABFUMCT
 F03DH SYM  CURPUSCT
 [illegible]H SYM  LASFUSCT
 [illegible]5H SYM  UBRCTR
 [illegible] SYM  TADV
 F049H SYM  LENADJFLAG
 F04[illegible] SYM  SHORFLAG
 F[illegible]AH SYM  I
 [illegible]058H SYM  MAIN
 0089H SYM  LOOP
      MOD  DEFID
 [illegible]07A SYM  IOINT
 [illegible]D8H SYM  FICINT
      MOD  [illegible]
      [illegible]H  MEMORY
      [illegible]H  READSET[illegible]
 [illegible]  THRFT
 F04EH SYM  DRUMDIA
 F050H SYM  DTARFT
 F055H SYM  FDRUMDIA
 00E6H SYM  FK1
 00EAH SYM  FK2
 F059H SYM  DDRUMDIA
 F05DH SYM  CONTROL
 F063H SYM  STRING
      MOD  SAMPLE
 00FFH SYM  RLSB
```

```
[illegible] OBJECT LOCATER V3.[illegible] INVOKED [illegible]
-LOCATE :F1:FCMAIN.LNK CODE(0040H) DAT[illegible]0H) STACKSIZE(200H) &
** SYMBOLS MAP PRINT(:LP:)   RESTARTO ORDER(CODE,DATA,STACK,MEMORY)
```

```
SYMBOL TABLE OF MODULE FCMAIN
[illegible]D FROM FILE :F1:FCMAIN.LNK
 [illegible]TEN TO FILE :F1:FCMAIN

VALUE TYPE SYMBOL

      MOD  MAINMOD
 [illegible]E3H SYM  MEMORY
 F000H SYM  DRUMCT
 F004H SYM  FCLEED
 0040H SYM  INITCNT
```

```
 [illegible]FH SYM  PMSP
 [illegible]JH SYM  T1
 0072H SYM  TIMC
 [illegible]0BFH SYM  TMODE
 [illegible]23CH SYM  SETR
      MOD  FTCNT
 0030H SYM  TOMO
 00BFH SYM  TMODE
 [illegible]249H SYM  SETCT
      MOD  DRUMCT
 0000H SYM  LTO
```

```
 ?CH SYM  TO
  .FH SYM  TMODE
0254H SYM  PCRD
      MOD  STPDIST
F285H SYM  MEMORY
F069H SYM  FSFEED1
F060H SYM  FSFEED2
F071H SYM  FSFEED
026EH SYM  STOPDISTANCE
F073H SYM  STAT
F376H SYM  DELTACT
      MOD  FOOTAGECONTROL
F285H SYM  MEMORY
F07AH SYM  STAT1
F078H SYM  STAT2
F07CH SYM  DECFLAG
0334H SYM  DECELERATION
      MOD  DISPLAY
F285H SYM  MEMORY
03EEH SYM  BIBCD
F07DH SYM  IBINPTR
```

```
 .4H SYM  I
1587H SYM  RESET
0001H SYM  RESTART
159AH SYM  FIX
READ FROM FILE :F1:FCMAIN.LNK
WRITTEN TO FILE :F1:FCMAIN
MODULE START ADDRESS 0055H

START   STOP LENGTH REL NAME

 ..00H  0002H    3H  A  ABSOLUTE
0008H  0004H    3H  A  ABSOLUTE
0010H  0012H    3H  A  ABSOLUTE
0018H  001AH    3H  A  ABSOLUTE
0020H  0022H    3H  A  ABSOLUTE
0028H  002AH    3H  A  ABSOLUTE
0033H  0034H    3H  A  ABSOLUTE
0040H  1547H  1568H  B  CODE
F000H  F0E4H   E5H  B  DATA
FCB5H  F2B4H  200H  B  STACK
F2E5H  F6FFH  40BH  B  MEMORY
```

```
1515-11 ABSOLUTE LINKER V5.0 INVOKED BY:
-LINK :F1:FMAIND.OBJ,:F1:FCIOI.OBJ,:F1:FCINTD.OBJ,:F1:FCRTI.OBJ,:F1:FCFCI.OBJ,&
**:F1:FCFCRD.OBJ,:F1:FCSTPD.OBJ,:F1:FCDECD.OBJ,:F1:DISPLY.OBJ,:F0:FPAL.LIB,&
**:F0:PLM80.LIB,:F1:FCITRD.OBJ TO :F1:FMAIND.LNK MAP PRINT(:LP:)
```

```
F075H SYM  BCDPTR
F031F SYM  CARRYUNDER
F033H SYM  BCDADJ
F084H SYM  BINBCD
 ?B1H SYM  X
   .H SYM  DISPLY
 .E7H SYM  DISPLYD
 ..   SYM  DISPLYL
02    SYM  FADJSL
F.    SYM  CTADJ
 .90H SYM  FROLD2
0534H SYM  LENADJ
F094H SYM  I
F095H SYM  DCTTEMP
 .61FH SYM  CLRFG
 .99F SYM  CTSTFT
  .?H SYM  FRCL
      SYM  DATADISPLAY
      SYM  INCPUSCT
 .E3H SYM  IRCLD
FCA9H SYM  ITCTFT
F0ADH SYM  STAT
      MOD  ITRPT
F285H SYM  MEMORY
FCAEH SYM  LFROL
1406H SYM  RPITR
FCB2H SYM  I
14B6H SYM  SRITR
FCB3H SYM  I
1531H SYM  DPITR
 ?9H SYM  SHTBR
```

```
 ?K MAP OF MODULE FMAIND
  .TTEN TO FILE :F1:FMAIND.LNK
MODULE IS A MAIN MODULE

SEGMENT INFORMATION:
START   STOP LENGTH REL NAME

              1591H  B  CODE
                01F  B  DATA
                 67H  B  STACK
0008H  0004H    3H  A  ABSOLUTE
0010H  0012H    3H  A  ABSOLUTE
0018H  001AH    3H  A  ABSOLUTE
0020H  0022H    3H  A  ABSOLUTE
0028H  002AH    3H  A  ABSOLUTE
0033H  0034H    3H  A  ABSOLUTE

INPUT MODULES INCLUDED:
 :F1:FMAIND.OBJ(MAINMOD)
 :F1:FCIOI.OBJ(DEFID)
 :F1:FCINTD.OBJ(INIT)
 :F1:FCRTI.OBJ(SAMPLE)
 :F1:FCFCI.OBJ(FTCNT)
 :F1:FCFCRD.OBJ(DRUMCT)
 :F1:FCSTPD.OBJ(STPDIST)
 :F1:FCDECD.OBJ(FOOTAGECONTROL
 :F1:DISPLY.OBJ(DISPLAY)
 :F0:FPAL.LIB(FADD)
 :F0:FPAL.LIB(FCMPR)
 :F0:FPAL.LIB(FGFD2B)
```

```
:F0:FPAL.LIB(FDIV)
:F0:FPAL.LIB(FIXSD)
:F0:FPAL.LIB(FLOAD)
:F0:FPAL.LIB(FLTDS)
:F0:FPAL.LIB(FMUL)
:F0:FPAL.LIB(FSET)
 :F0:FPAL.LIB(FSQRT)
        LIB(FSTCR)
   .. .LIB(FZTST)
 :F0:FPAL.LIB(@CHECK)
 :F0:FPAL.LIB(FCLR)
:F0:FPAL.LIB(FERHND)
:F0:FPAL.LIB(FNEG)
:F0:FPAL.LIB(@MPLY)
:F0:FPAL.LIB(@NORML)
:F0:FPAL.LIB(F0FT10)
:F0:FPAL.LIB(F0FX10)
:F0:FPAL.LIB(@ROUND)
:F0:FPAL.LIB(@SHIFT)
:F0:PLM80.LIB(@P0011)
:F0:PLM80.LIB(@P0014)
 :F0:PLM80.LIB(@P0025)
  0:PLM80.LIB(@P0029)
 :F0:PLM80.LIB(@P0036)
 :F0:PLM80.LIB(@P0045)
 :F0:PLM80.LIB(@P0091)
 :F0:PLM80.LIB(@P0091)
 :F0:PLM80.LIB(@P0093)
:F0:PLM80.LIB(@P0101)
:F0:PLM80.LIB(@P0103)
:F1:FCITRD.OBJ(ITRPT)
```

```
F023H SYM  BCDB
F025H SYM  BCDL
F031H SYM  FRDSC
F033H SYM  FFTSC
F035H SYM  CUDRUMCT
F039H SYM  LADRUMCT
   H SYM  DURPUSCT
F041H SYM  LASPUSCT
F043H SYM  UDPCTR
F047H SYM  I
F049H SYM  LENADJFLAG
F049H SYM  SHDRFLAG
F04AH SYM  INITROLCNT
   SYM  MAIN
        LOOP
   ...  ...
  0BH SYM  ...
0DDCH SYM  FICINT
      MOD  INIT
F2C1H SYM  MEMORY
00F2H SYM  READSETPOINTS
F04BH SYM  TARDIA
F04EH SYM  IRUMDIA
F050H SYM  DTARDIA
F055H SYM  FDRUMDIA
00EAH SYM  FK1
00EEH SYM  FK2
F059H SYM  DDRUMDIA
F05DH SYM  CONTROL
F063H SYM  STRING
      MOD  SAMPLE
```

```
...S-11 OBJECT LOCATER V3.. INVOKED ...
-LOCATE :F1:FMAIND.LNK CODE(0040H) D... F000H) STACKSIZE(200H) &
-* SYMBOLS MAP PRINT(:LP:)  RESTARTO ORDER(CODE,DATA,STACK,MEMORY)

SYMBOL TABLE OF MODULE FMAIND
LOAD FROM FILE :F1:FMAIND.LNK
  TTEN TO FILE :F1:FMAIND

VALUE TYPE SYMBOL

      MOD  MAINMOD
F2C1H SYM  MEMORY
F000H SYM  IRUMCT
F004H SYM  PULSEC
0040H SYM  INITCNT
0041H SYM  FDIATOL
0045H SYM  FDELTAT
0049H SYM  FZDECL
004DH SYM  FNUM2
0051H SYM  FK
0055H SYM  FCALIF
F008H SYM  LAYERCTR
F009H SYM  FPR
F01EH SYM  FTARDIA
F01FH SYM  FSTOPS
```

```
  TFH SYM  RLSB
   .H SYM  RMSB
0DDDH SYM  T1
0070H SYM  T1MO
0DDFH SYM  TMODE
0240H SYM  SETR
0DDCH SYM  T0
0030H SYM  T0MO
0DDFH SYM  TMODE
024DH SYM  SETCT
      MOD  DRUMCT
  00H SYM  LT0
  0CH SYM  T0
0DDFH SYM  TMODE
0258H SYM  PCRD
      MOD  STPDIST
F2C1H SYM  MEMORY
F069H SYM  FSPEED1
F06DH SYM  FSPEED2
F071H SYM  FSPEED
0274H SYM  STOPDISTANCE
```

```
F075H SYM  STAT
F076H SYM  DELTACT
      MOD  FOOTAGECONTROL
F2C1H SYM  MEMORY
F07AH SYM  FROLD2
F07EH SYM  FSTPDIA
F082H SYM  STAT1
F083H SYM  STAT2
F084H SYM  DECFLAG
0338H SYM  F10
F085H SYM  FROLD1
033CH SYM  DECELERATION
0401H SYM  FINI
      MOD  DISPLAY
F2C1H SYM  MEMORY
0400H SYM  BIBCD
   7H SYM  IBINPTR
 08H SYM  BCDPTR
 09DH SYM  CARRYCNTER
 0EFH SYM  BCDADJ
 090H SYM  BINQUO
 92H SYM  X
 0 H SYM  DISPLY
     M  DISPLYB
        DISPLYL
 0A SYM  ....
 093H SYM  CTADJ
 09CH SYM  FROLD2
 0559H SYM  LENADJ
F0A0H SYM  I
F0A1H SYM  DCTTEMP
0643H SYM  CLRFG
F0A5H SYM  FTOTFT
F0A9H SYM  FROLD
0649H SYM  DATADISPLAY
F0ADH SYM  INCPUSCT
F0B1H SYM  IROLD
F0B5H SYM  ITOTFT
F0B9H SYM  STAT
      MOD  ITRPT
F2C1H SYM  MEMORY
 AH SYM  LFROL
 2H SYM  RPITR
F0BEH SYM  I
15DFH SYM  SRITR
F0BFH SYM  I
165A4 SYM  DPITR
F0C0H SYM  I
16B0H SYM  RESET
0001H SYM  RESTART
16C3H SYM  FIX

MORY MAP OF MODULE FMAIND
  J FROM FILE :F1:FMAIND.LNK
WRITTEN TO FILE :F1:FMAIND
MODULE START ADDRESS 0059H

START   STOP LENGTH REL NAME

0000H  0002H    3H  A  ABSOLUTE
0008H  000AH    3H  A  ABSOLUTE
0010H  0012H    3H  A  ABSOLUTE
0018H  001AH    3H  A  ABSOLUTE
0020H  0022H    3H  A  ABSOLUTE
0028H  002AH    3H  A  ABSOLUTE
0038H  003AH    3H  A  ABSOLUTE
0040H  16D0H  1691H  B  CODE
F000H  F0C0H   C1H  B  DATA
F0C1H  F2C0H  200H  B  STACK
F2C1H  F6BFH  3FFH  B  MEMORY
```

```
000300: 2B 71 2A 7D F0 [illegible] 23 EB 3E 01 CD EF 13 DA [illegible] 04   +q*}.#&.>.......
000400: 21 99 19 22 81 F0 21 83 F0 36 06 C3 18 04 21 00   !.."..!..6....!.
000410: 00 22 81 F0 7D 32 83 F0 2A 7D F0 5E 23 56 21 0A   ."..}2..*}.^#V!.
000420: 00 CD 88 13 7D 21 83 F0 86 2A 7F F0 77 2A 7D F0   ....}!...*..w*}.
000430: 5E 23 56 21 0A 00 CD 88 13 2A 81 F0 19 22 84 F0   ^#V!.....*..."..
000440: 21 86 F0 36 01 3E 04 21 86 F0 BE DA 79 04 2A 84   !..6.>.!....y.*.
000450: F0 EB 21 0A 00 CD 88 13 7D 2A 86 F0 26 00 EB 2A   ..!.....}*..&..*
000460: 7F F0 19 77 2A 84 F0 EB 21 0A 00 CD 88 13 EB 22   ...w*...!......"
000470: 84 F0 21 86 F0 34 C2 45 04 21 86 F0 36 00 3E 04   ..!..4.E.!..6.>.
000480: 21 86 F0 BE 0A BB 04 2A 86 F0 26 00 EB 2A 7F F0   !......*..&..*..
000490: 19 7E FE 0A DA B4 04 2A 86 F0 26 00 EB 2A 7F F0   .......*..&..*..
0004A0: 19 7E 06 0A 77 2A 86 F0 26 00 01 01 00 09 EB 2A   ....w*..&......*
0004B0: 7F F0 19 34 21 86 F0 34 C2 7E 04 C9 3A 24 F0 87   ...4!..4....:$..
0004C0: 87 87 87 21 23 F0 86 32 87 F0 3A 25 F0 32 88 F0   ...!#..2..:%.2..
0004D0: 3A 29 F0 87 87 87 87 87 21 28 F0 [illegible] 32 89 F0 3A 2B F0   :.....!(..2..:+
0004E0: F0 87 87 87 87 21 2A F0 36 32 3A F0 3A 2C F0 32   .....!*..2..:,.2
0004F0: 8B F0 3A 87 F0 D3 E5 3E 1E D3 EA 3E 1F D3 EA 3A   ..:....>...>...:
000500: 88 F0 D3 E5 3E 1D D3 EA 3E 1F D3 EA 3A 89 F0 D3   ....>...>...:...
000510: E5 3E 1B D3 EA 3E 1F D3 EA 3A 8A F0 D3 E5 3E 17   .>...>...:....>.
000520: D3 EA 3E 1F D3 EA 3A 8B F0 D3 E5 3E 0F D3 EA 3E   ..>...:....>...>
000530: 1F D3 EA C9 11 9D F0 01 09 F0 CD A0 0D 11 9D F0   ................
000540: 01 09 F0 CD 87 0E 11 90 F0 01 09 F0 CD 17 10 11   ................
000550: AE F0 01 09 F0 CD A0 0D 11 AE F0 01 09 F0 CD 87   ................
000560: 0E 11 90 F0 01 09 F0 CD 34 06 11 E4 03 01 09 F0   ....6...........
000570: CD 87 0E 11 51 00 01 09 F0 CD 94 0B 11 9C F0 01   ....Q...........
000580: 09 F0 CD EB 0C 3E 80 06 80 D6 01 9F 11 9E F0 CD   .....>..........
```

```
000590: 7B 13 7D 1F D2 9A 05 C3 1F 06 11 02 F0 01 8E F0   {.}.............
000[illegible]A0: CD D2 13 D2 A9 05 C3 1F 06 01 8C F0 11 [illegible] F0 CD   ................
000[illegible]B0: E2 13 22 95 F0 01 8E F0 11 02 F0 CD E2 13 22 97   ..".........."..
000[illegible]C0: F0 01 8C F0 11 00 F0 CD E2 13 D2 D4 [illegible] 2A 97 F0   .............*..
000[illegible]D0: 2F 22 97 F0 21 94 F0 36 00 3E 01 21 94 F0 BE DA   /"..!..6.>.!....
000[illegible]50: 06 06 2A 94 F0 26 00 01 95 F0 29 09 0B 0A 4F 06   ..*..&....)...O.
000[illegible]F0: 00 E5 21 00 F0 09 09 E3 4E 23 46 E1 71 23 70 21   ..!.....N#F.q#p!
000[illegible]00: 94 F0 34 C2 D9 05 3E 30 D3 DF 2A 00 F0 CD B7 13   ..4...>0..*.....
000610: 7D D3 DC 7C D3 DC 2A 02 F0 CD B7 13 22 45 F0 21   }..|..*.....".E.!
000620: 48 F0 36 00 C9 01 41 F0 11 3D F0 CD E2 13 22 A1   H.6...A..=....".
000630: F0 01 43 F0 11 3F F0 CD E2 13 22 A3 F0 01 41 F0   ..C..?...."...A.
000640: 11 3D F0 CD E2 13 D2 50 06 2A A3 F0 2B 22 A3 F0   .=.....P.*..+"..
000650: 11 A1 F0 01 09 F0 CD FB 0D 11 2D F0 01 09 F0 CD   ..........-.....
000660: 87 0E 11 9D F0 01 09 F0 CD 17 10 11 A5 F0 01 09   ................
000670: F0 CD EB 0C 3A 48 F0 FE 01 C2 84 06 CD 34 05 21   ....:H.......4.!
000[illegible]80: 49 F0 36 00 11 00 F0 01 09 F0 CD FB 0D 11 31 F0   I.6...........1.
000[illegible]: 01 09 F0 CD 87 0E 11 99 F0 01 09 F0 CD 17 10 11   ................
000[illegible]: A9 F0 01 09 F0 CD EB 0C 11 23 F0 01 A5 F0 CD EB   .........#......
0006B0: 03 11 28 F0 01 A9 F0 CD E8 03 CD BC 04 C9 F5 3E   ..(............>
0006C0: 01 C3 C7 06 F5 3E 02 E5 F5 CD 76 10 FE 02 CA E8   .....>....v.....
0006D0: 06 DA 76 08 FE 03 C2 B0 07 CD A0 0D F1 FE 01 CA   ..v.............
0006E0: B1 07 CD F5 11 C3 B1 07 F1 F5 F5 C5 D5 C5 FE 01   ................
0006F0: 7C CA F7 06 C6 80 67 E5 21 11 00 09 BE 3E 00 CA   |.....g.!....>..
000700: 04 07 C6 03 C1 41 4F 78 2B 96 CA 16 07 D2 17 07   .....AOx+.......
000710: 2F 3C 46 C3 18 07 0C 0C 0C C5 F5 79 F5 2B 4E 2B   /<F........y.+N+
000720: 46 2B 7E 60 6F EB 7E F5 23 46 23 7E EB F6 80 50   F+.~`o...~#F#...P
000730: 47 F1 5F F1 FE 04 D2 B4 07 FE 02 CA 4B 07 DA 47   G._.........K..G
000740: 07 F1 3E 00 C3 56 07 EB 78 41 4F F1 D5 C5 06 00   ..>..V..xAO.....
000750: CD 17 13 D1 42 D1 F5 19 79 88 4F 06 00 D2 77 07   ....B...y.O...w.
000760: 1F 4F 7C 1F 67 7D 1F 6F D1 7A 1F E6 E0 5F 7A E6   .O|.g}.o.z...._z.
000770: 20 B3 06 01 C3 78 07 F1 CD F5 12 80 57 F1 82 51   ....x......W..Q
0007F0: C1 E5 21 0D 00 09 C1 71 23 70 23 72 23 D1 C1 FE   ..!....q#p#r#...
000790: FF CA 9A 07 77 3E 10 C3 A9 07 DE BE 77 03 03 03   ....w>......w...
0007A0: 0A F6 40 D2 0B 0B 0B 7E 13 D2 FE 13 CA 75 08 E1   ..@....~.....u..
0007B0: E1 C1 F1 C9 CA F8 07 FE 05 CA 01 08 7B 95 [illegible] 7B   ............{.{
000000: C2 55 00 FF FF [illegible] FF FF C3 06 14 FF FF FF [illegible] FF   .U..............
000010: C3 B6 14 FF FF FF FF FF C3 31 15 FF FF FF FF FF   .........1......
000020: C3 49 15 FF FF FF FF FF C3 87 15 FF FF FF FF FF   .I..............
000030: FF FF FF FF FF FF FF FF C3 9A 15 FF FF FF FF FF   ................
000040: C9 00 00 00 00 D0 D3 F9 3E 00 00 80 40 00 00 00   ........>...@...
000050: 40 00 0E 3E 3B 31 B5 F2 3A 40 00 32 08 F0 21 FF   @..>;1..:@.2..!.
000060: FF 22 45 F0 21 47 F0 36 00 23 36 00 23 36 00 CD   ."E.!G.6.#6.#6..
000070: C7 00 CD D8 0C CD EE 00 CD 3C 02 CD 49 02 01 00   .........<..I...
000080: F0 CD 54 02 01 04 F0 CD 54 02 21 4A F0 36 00 3E   ..T.....T.!J.6.>
000090: 01 21 4A F0 BE DA B9 00 2A 4A F0 26 00 01 04 F0   .!J.....*J.&....
0000A0: 09 EB 2A 4A F0 26 00 01 41 F0 29 09 D1 1A 77 23   ..*J.&..A.)...w#
0000B0: 36 00 21 44 F0 34 C2 BF 00 CD 6E 02 CD 34 05 CD   6.!D.4....n..4..
0000C0: 27 06 C2 B9 00 FB 76 3E 99 D3 E7 3E 80 D3 E8 3E   '.....v>...>...>
0000D0: FF DC F9 3E 1F D3 EA C9 3E 12 DC DC 3E [illegible] D3 D8   ...>....>...>...
0000E0: 3E C1 D3 D9 FB C9 2A 42 09 3A [illegible] 97 A3 3C 3F 19   >.....*B.:....<?.
0000F0: D6 E9 DB E6 32 4D F0 3E 1A D3 E9 DB E6 32 4C F0   ....2M.>......2L.
000100: 3E 1C D3 E9 DB E6 32 4D F0 3E 18 D3 E9 3A 4B F0   >.....2M.>...:K.
000110: E6 0F C6 30 32 50 F0 2A 4C F0 26 00 EB 21 10 00   ...02P.*L.&..!..
000120: CD 88 13 21 30 00 19 EB 21 01 F0 73 3A 4C F0 E6   ...!0...!..s:L..
000130: 0F C6 30 23 77 2A 4D F0 26 00 EB CD 88 13 21 30   ..0#w*M.&.....!0
000140: 00 19 EB 21 53 F0 73 3A 4D F0 E6 0F C6 30 23 77   ...!S.s:M....0#w
000150: 01 09 F0 CD 11 00 00 01 00 00 CD DD 0F 11 69 F0   ..............i.
000160: 01 09 F0 CD 17 10 21 5D F0 36 2B 3E 00 23 77 23   ......!].6+>.#w#
000170: 36 00 23 36 05 01 50 F0 23 71 23 70 11 5D F0 01   6.#6..P.#q#p.]..
000180: 09 F0 CD 30 09 11 1B F0 01 09 F0 CD 17 10 3E 10   ...0..........>.
000190: D3 E9 DB E4 2F 32 4E F0 3E 08 D3 E9 DB E4 2F 32   ..../2N.>...../2
0001A0: 4F F0 3E 18 D3 E9 3A 4E F0 26 00 EB 21 10 00 CD   O.>...:N.&..!...
0001B0: 88 13 21 30 00 19 EB 21 59 F0 73 3A 4F F0 E6 0F   ..!0...!Y.s:N...
0001C0: C6 30 23 77 2A 4F F0 26 00 EB CD 88 13 21 30 00   .0#w*O.&.....!0.
0001D0: 19 EB 21 58 F0 73 3A 4F F0 E6 0F C6 30 23 77 23   ..!L.s:O....0#w#
0001E0: 36 2B 01 FE FF 22 71 23 70 23 36 04 01 59 F0 23   6+...#q#p#6..Y.#
0001F0: 71 23 70 11 5B F0 01 09 F0 CD 30 09 11 55 F0 01   q#p.[.....0..U..
000200: 09 F0 CD 17 10 11 E6 [illegible] 01 09 F0 CD A0 0D 11 35   ...............U
000210: F0 01 09 F0 CD 87 0E 11 31 F0 01 09 F0 CD 17 10   ........1.......
000220: 11 EA 00 01 09 F0 CD A0 0D 11 55 F0 01 09 F0 CD   ..........U.....
000230: 87 0E 11 2D F0 01 09 F0 CD 17 10 C9 3E 70 D3 DF   ...-........>p..
000240: 3E FF D3 DD 3E FF D3 DD C9 3E 30 D3 DF 3E FF D3   >...>....>0..>..
```

```
000250: DC D3 DC C9 3E 00 D3 DF DB DC 2F 02 03 DB DC 2F    ....>.....//..../
000260: 02 03 21 45 F0 7E 2F 02 03 23 7E 2F 02 C9 01 39    ..!E../..#./...9
000270: F0 11 35 F0 CD E2 13 22 76 F0 01 3B F0 11 37 F0    ..5....."v..;..7.
000280: CD E2 13 22 78 F0 01 39 F0 11 35 F0 CD E2 13 02    ..."x..9..5.....
000290: 2A 78 F0 2B 22 78 F0 01 09 F0 C5 11 00 00          *x.+"x........
0002A0: 01 76 00 CF DB 0F 11 76 F0 01 09 F0 CD FB 0D 01    .....v.........
0002B0: 07 F0 CD 3A 10 32 75 F0 3A 75 F0 E6 C0 4F 3E 00    ...:.2u.:u...O>.
0002C0: B9 D2 E2 02 11 31 F0 01 09 F0 EB 87 0E 11 45 00    .....1........E.
0002D0: 01 09 F0 CD 94 0B 11 6D F0 01 09 F0 CD 17 10 C3    .......m........
0002E0: EB 02 11 69 F0 01 09 F0 CD A0 0D 11 69 F0 01 09    ...i........i...
0002F0: F0 CD BE 06 11 4D 00 01 09 F0 CD 94 0B 11 71 F0    .....M........q.
000300: 01 09 F0 CD 17 10 11 71 F0 01 09 F0 CD 87 0E 11    .......q........
000310: 49 00 01 09 F0 CD 94 0B 11 1F F0 01 09 F0 CD 17    I...............
000320: 10 11 6D F0 01 09 F0 CD A0 0D 11 69 F0 01 09 F0    ..m........i....
000330: CD 17 10 C9 11 1B F0 01 09 F0 CD A0 0D 11 99 F0    ................
000340: 01 09 F0 CD C4 06 11 41 00 01 09 F0 CD 8E 08 32    .......A.......2
000350: 7A F0 3A 7A F0 E6 A0 4F 3E 00 B9 D2 66 03 21 7C    z.:z...O>...f.!|
000360: FC 36 00 C3 BF 03 3A 47 F0 FE 00 C2 A1 03 11 71    .6....:G.......q
000370: F0 01 09 F0 CD A0 0D 11 49 00 01 09 F0 CD 87 0E    ........I.......
000380: 11 1F F0 01 09 F0 CD BE 06 11 99 F0 01 09 F0 CD    ................
000390: BE 06 11 1B F0 01 09 F0 CD 8E 08 32 7B F0 C3 BF    ...........2{...
0003A0: 03 11 1F F0 01 09 F0 CD A0 0D 11 99 F0 01 09 F0    ................
0003B0: CD BE 06 11 1B F0 01 09 F0 CD 8E 08 32 7B F0 3A    ............2{.:
0003C0: 7B F0 E6 C0 4F 3E 00 B9 D2 D8 03 21 7C F0 36 00    {...O>.....!|.6.
0007E0: C2 27 08 BC C2 [illegible] 08 BD C2 27 08 C1 C1 C1 [illegible] F1    .'...'...'......
0007F0: 10 D1 C1 E1 E1 E1 F1 C9 EB 78 41 4F 3E 00 C3 03    .........xAO>...
000800: 08 3E 01 E5 21 0D 00 39 77 E1 97 95 6F 3E 00 9C    .>..!..9w...o>..
000810: 67 3E 00 99 4F F1 F5 D5 C5 06 FF CD 17 13 D1 42    g>..O..........B
000820: D1 F5 19 79 88 4F F1 CD 63 12 CD F5 12 5F F1 F1    ...y.O..c....._..
0830: 83 90 51 C1 F5 E5 21 0D 00 09 C1 71 23 70 23 72    ..Q...!....q#p#r
000840: 23 F1 D1 C1 DA 51 08 B7 CA 51 08 77 3E 10 C3 60    #....Q...Q.w>..`
000850: 08 C6 BE 77 03 03 03 0A F6 20 02 0B 0B 0B 3E 14    ...w..... ....>.
000860: C2 F1 B7 CA 6B 08 23 7E C6 80 77 0A E6 07 C2 76    ....k.#...w....v
000870: 08 E1 E1 F1 C9 F1 F1 C5 C5 21 8A 08 E5 21 01 00    .........!...!..
000880: 09 4E 23 46 60 69 4F 06 00 E9 C1 E1 F1 C9 E5 D5    .N#F`iO.........
000890: CD 7A 10 FE 02 CA B1 08 DA 1B 09 FE 04 CA EA 08    .z..............
0008A0: 21 00 00 D2 31 08 13 13 13 1A 17 DA F2 08 C3 FA    !...............
0008B0: 08 EB 21 11 00 09 7A BE DA FA 08 C2 F2 08 7B 21    ..!.....z.....{!
0008C0: 7A 0A 0F 09 C2 03 09 2B D1 D5 13 13 1A F6 80 BE    .......+........
0008D0: DA 0F 09 C2 03 09 1B 2B 1A BE DA 0F 09 C2 03 09    .......+........
0008E0: 2B 1B 1A BE DA 0F 09 C2 03 09 0A E6 10 F6 80 C3    +...............
0008F0: FF 08 0A E6 10 F6 40 C3 FF 08 0A F6 10 F6 20 02    ......@.......  .
000900: D1 E1 C9 21 11 00 09 7E 17 DA F2 08 C3 FA 08 21    ...!.......~.....!
000910: 11 00 09 7E 17 DA FA 08 C3 F2 08 C5 C5 21 2B 09    ...~.........!+.
000920: E5 03 0A 6F 03 0A 67 01 06 00 E9 C1 0A C3 00 09    ...o..g.........
000930: 21 EB FF 39 F9 D5 C5 21 02 00 39 4E 23 46 21 06    !..9...!..9N#F!.
000940: 00 39 71 23 70 03 21 0C 00 39 71 23 70 21 02 00    .9q#p.!..9q#p!..
000950: 39 4E 23 46 03 03 03 21 0A 00 39 71 23 70 3E 04    9N#F...!..9q#p>.
000960: 21 02 00 39 CD 6F 13 2B 23 73 23 72 21 0C 00 39    !..9.o..#s#r!..9
000970: 4E 23 46 E5 60 69 4E 23 46 E1 23 71 23 70 21 0A    N#F.`iN#F.#q#p!.
000980: 00 39 4E 23 46 0A 21 10 00 39 77 EB 4E 23 46 21    .9N#F.!..9w.N#F!
000990: 08 00 39 71 23 70 21 08 00 39 4E 23 46 0A D6 30    ..9q#p!..9N#F..0
0009A0: D6 01 9F 21 10 00 39 F5 7E D6 00 C6 FF 9F C1 48    ... ..9.........H
0009B0: A1 1F D2 C9 09 21 00 00 39 4E 23 46 03 2B 71 23    .....!..9N#F.+q#
0009C0: 70 21 10 00 39 35 C2 96 09 21 10 00 39 7E FD 4F    p!..95...!..9.=O
0009D0: 06 00 21 08 00 39 EB CD 6F 13 7E D6 30 D6 01 9F    ..!..9..o...0...
0009E0: 21 10 00 39 F5 7E D6 00 C6 FF 9F C1 48 A1 1F D2    !..9........H...
0009F0: 04 0A 21 10 00 39 35 2B 2B 4E 23 46 03 2B 71 23    ..!..95++N#F.+q#
000A00: 70 C3 C9 09 21 10 00 39 7E FE 00 C2 1E 0A 21 00    p...!..9......!.
000A10: 00 39 4E 23 46 CD F1 10 21 19 00 39 F9 C9 21 13    .9N#F...!..9..!.
000A20: 00 39 36 00 23 36 00 23 36 00 23 36 00 3E 09 21    .96.#6.#6.#6.>.!
000A30: 10 00 39 BE D2 40 0A 21 17 00 39 36 09 C3 4A 0A    ..9..@.!..96..J.
000A40: 21 10 00 39 7E 21 17 00 39 77 21 18 00 39 36 00    !..9.!..9w!..96.
000A50: 21 17 00 39 7E 3D 23 BE DA 7F 0A 21 13 00 39 E5    !..9.=#....!..9.
000A60: 21 1A 00 39 4E 06 00 21 0A 00 39 EB CD 66 13 7E    !..9N..!..9..f..
000A70: D6 30 5F C1 CD 9B 12 21 18 00 39 34 C2 50 0A 21    .0_....!..94.P.!
000A80: 13 00 39 E5 21 02 00 39 4E 23 46 D1 CD FB 0D 21    ..9.!..9N#F....!
000A90: 13 00 39 7E 21 0E 00 39 CD 6F 13 E5 21 19 00 39    ..9.!..9.o..!..9
000AA0: 7E 21 CD D8 13 EB 21 0E 00 39 73 23 72 EB 11 00    .....!..9s#r...
000AB0: 80 CD D1 13 9F 21 11 00 39 77 1F D2 CA 0A 21 0E    .....!..9w....!.
000AC0: 00 39 CD AA 13 EB 2B 73 23 72 3E 3F 21 0E 00 39    .9....+s#r>?!..9
000AD0: CD FA 13 D2 E0 0A 3E 3F 21 0E 00 39 77 23 36 00    ......>?!..9w#6.
```

```
000AE0: 21 12 00 39 36 00 2B 7E 1F D2 33 0B 3E 00 21 0E   !..96.+...3.>.!.
000AF0: 00 39 CD FA 13 B5 CA 30 0B 21 0E 00 39 7E 1F D2   .9.....0.!..9...
000B00: 1B 0B 21 12 00 39 6E 26 00 29 29 01 83 12 09 E5   ..!..9n&.))....
000B10: 21 02 00 39 4E 23 46 D1 CD 94 0B 0E 01 21 0E 00   !..9N#F......!..
000B20: 39 CD BE 13 EB 2B 73 23 72 23 23 23 34 C3 EC 0A   9....+s#r###4...
000B30: C3 77 0B 3E 00 21 0E 00 39 CD FA 13 B5 CA 77 0B   .w.>.!..9.....w.
000B40: 21 0E 00 39 7E 1F D2 62 0B 21 12 00 39 6E 26 00   !..9...b.!..9n&.
000B50: 29 29 01 83 12 09 E5 21 02 00 39 4E 23 46 D1 CD   ))....!..9N#F..
000B60: B7 0E 0E 01 21 0E 00 39 CD BE 13 EB 2B 73 23 72   ....!..9....+s#r
000B70: 23 23 23 34 C3 33 0B 21 06 00 39 4E 23 46 0A FE   ###4.3.!..9N#F..
000B80: 2D C2 8E 0B 21 00 00 39 4E 23 46 CD F5 11 21 19   -...!..9N#F...!.
000B90: 00 39 F9 C2 F5 E5 C5 7E 10 FE 02 CA BA 0B DA B7   .9.....v........
000BA0: 7C 7E C3 E2 39 0B C3 F8 0C 21 76 01 E6 F9 02 21   ................!
000BB0: 00 E5 E5 21 01    E5 EB 5E 23 56 F5 23 7E    30   ...!....^#V.#...
000BC0: 69 60 47 F1 37 3F E5 F5 F5 4F 7D 93 6F 7C 9A 67   i`G.7?...O}.o|.g
000BD0: 79 98 D2 06 0C 4F F1 79 DA 08 0C F1 E1 E3 29 DA   y....O.y......).
000C00: 18 0C E3 C3 13 0C 33 33 33 33 33 33 E3 29 23 DA   ......333333.)#.
000C10: 18 0C E3 29 8F C3 E6 0B E3 3B 3B E5 F5 21 0A 00   ...).....;;..!..
000C20: 39 7E 3D CA 38 0C 2B 2B 77 2B 2B 2B 36 00 2B 36   9.=.8.++w+++6.+6
000C30: 7F F1 E1 29 8F C3 E6 0B 0E 20 F1 E1 B7 C2 4C 0C   ...).... ....L.
000C40: 7C B7 C2 4C 0C 7B B7 C2 4C 0C 0E 00 E1 E1 D1 06   |..L.}..L.......
000C50: 00 29 29 29 29 29 29 7A 17 DA 6A 0C 06 01 29 EB   .)))))z..j...).
000C60: DA 67 0C 29 C3 69 0C 29 23 EB 7D D1 6C 63 4A CD   .g.).i.)#.}.lcJ.
000C70: F5 12 EB E1 E1 E1 73 23 72 23 71 23 4F 3E 7F 81   ......s#r#q#O>..
000C80: 00 47 F1 B0 4F 06 01 DA 8C 0C 06 00 D1 79 93 5F   .G..O.........y._
000C90: 78 DA A0 0C B7 C2 C6 0C 7B B7 CA B3 0C C3 AA 0C   x.......}.......
000CA0: B7 CA B3 0C 78 FE FF CA C6 0C 77 C1 3E 10 C2 D1   ....x.....w.>...
000CB0: E1 F1 C9 7B C6 BE 77 C1 21 03 00 09 7E F6 20 77   ...{..w.!.... w
000CC0: 3E 14 02 C3 B6 0C 7B 1F BE 77 C1 21 03 00 09 72   >.....{..w.!....
000CD0: F6 40 77 3E 13 02 D1 C5 C5 21 E7 0C E5 03 0A 6F   .@w>.....!.....o
000CE0: 03 0A 67 01 04 00 E9 C1 E1 F1 C9 F5 E5 C5 D5 0A   ..g.............
000CF0: E6 17 FE 15 CA 8B 0D 21 11 00 09 7E F5 2B 7E FE   .......!.....+..
000D00: 7F DA 60 0D 2B 46 2B 4E 2B 56 1E 00 FE 9E CA 43   ..`.+F+N+V.....C
000D10: 0D D2 77 0D D6 7F 6F 3E 1F 95 6F 97 78 1F 47 79   ..w...o>..o.x.Gy
000D20: 1F 4F 7A 1F 57 7B 1F 5F 2D C2 1B 0D F1 B7 CA 67   .Oz.W{._-......g
000D30: 0D 57 93 5F 3E 00 9A 57 3E 00 99 4F 3E 00 98 47   ...._>..W>..O>..G
000D40: C3 67 0D F1 B7 CA 78 0D 78 FE 80 C2 78 0D 79 B7   .g....x.x...x.y.
000D50: C2 78 0D 7A B7 C2 70 0D 7B B7 C2 78 0D C3 67 0D   .x.z..x.{..x..g.
000D60: 01 00 06 11 00 00 F1 E1 73 23 72 23 71 23 70 2B   ........s#r#q#p+
000D70: 2B 2B EB C1 E1 F1 C9 F1 D1 C1 C5 C5 3E 13 02 02   ++............>...
000D80: 02 05 CA F6 40 02 0B 7B C3 90 0D D1 C1 C5 C5 03   ....@.....{.....
000D90: 04 67 03 0A 67 01 9B 0B C5 01 05 00 E9 C3 73 0D   .g..g.........s.
000DA0: C5 F3 B0 21 0B 00 09 1A 77 23 13 1A 77 23 13 1A   ...!....w#..w#..
000DB0: F6 80 77 1A 17 13 23 1A 17 77 F5 23 1A E6 80 77   ..w...#..w.#...w
000DC0: F1 B7 CA D1 0D FE FF CA EE 0D 3E 10 02 D1 F1 E1   ..........>.....
000DD0: C9 2B 2B 7E E6 7F 77 23 23 97 BE C2 EE 0D 2B 2B   .++...w##.....++
000DE0: BE C2 EE 0D 2B BE C2 EE 0D 2B BE CA CC 0B 21 03   ....+....+....!.
000DF0: 00 09 7E F6 80 77 3E 15 C3 CC 0D F5 E5 D5 C5 21   .....w>........!
000E00: 11 00 09 E5 EB 5E 23 56 23 4E 23 46 7B B7 C2 36   .....^#V#N#F{..6
000E10: 0E 7A B7 C2 36 0E 79 B7 C2 36 0E 78 FE 80 CA 2E   .z..6.y..6.x....
000E20: 0E B7 C2 36 0E C1 C1 D1 CD F1 10 C3 B4 0E 3E 80   ...6..........>.
000E30: 48 06 9E C3 75 0E 78 E6 80 F5 CA 4C 0E 97 93 5F   H...u.x....L...._
000E40: 7F 00 9A 57 3E 00 99 4F 3E 00 98 47 EB 1E 00 29   >..W>..O>..G...)
000E50: 79 0E 8F 4F 78 8F 47 1C 17 D2 4F 0E 55 6C 61 48 7A   y.Ox.G...O.UlaHz
000E60: 2C 1F 7A CA 3A 0E E6 E0 F6 20 CD F5 12 57 3E 9E   ..z.:.... ...W>.
000E70: 93 82 EB 47 F1 E1 77 2B 70 2B 71 2B 72 2B 73 C1   ...G..w+p+q+r+s.
000E80: 3E 10 02 D1 E1 F1 C9 F5 E5 CD 76 10 FE 02 CA 9F   >.........v.....
000E90: 0E DA C7 0F FE 05 C2 DA 0F CD F1 10 C3 DA 0F D5   ................
000EA0: C5 E5 7C 21 11 00 09 86 77 2B 4E 06 00 E3 26 00   ..|!....w+N...&.
000EB0: 09 23 E3 2B 46 2B 4E 2B 7E E5 EB 5F 23 23 7E F6   .#.+F+N+...__##..
000EC0: 80 57 D5 2B 56 2B 5E 21 00 00 CD 23 12 E5 F5 21   .W.+V+^!...#...!
000ED0: 00 00 7A CD 23 12 E5 F5 21 00 00 7B CD 23 12 E5   ..z.#...!..{.#..
000EE0: F5 21 0C 00 39 7E 23 46 4A 57 21 00 00 CD 23 12   .!..9.#FJW!...#.
000EF0: E5 F5 21 00 00 06 00 4B 7A CD 23 12 7D 0E 80 B7   ..!....Kz.#.}...
000F00: C2 05 0F 0E 00 6C 26 00 F1 D1 19 CE 00 47 D2 12   .....l&......G..
000F10: 0F 0C F1 D1 19 88 D2 1A 0F 0C 47 7D 6C 60 B7 CA   ..........G}l`..
000F20: 26 0F 79 F6 80 4F F1 D1 19 CE 00 47 D2 33 0F 79   &.y..O.....G.3.y
000F30: F6 40 4F F1 D1 E5 6C 60 19 CE 00 47 79 E6 3F 84   .@O...l`...Gy.?.
000F40: 67 78 CE 00 D1 41 4F 78 E6 40 CA 4E 0F 0C 78 1F   gx...AOx.@.N..x.
000F50: 1F E6 20 B3 5F E6 3F 7B CA 5F 0F E6 E0 F6 20 5F   .. ._.?{._..... _
000F60: 79 E6 80 7B 06 00 C2 6E 0F 06 01 CD 63 12 CD F5   y..{...n....c...
000F70: 12 EB E1 E1 73 23 72 23 71 23 D1 4F 3E 7F 80 91   ....s#r#q#.O>...
```

```
000FB0: 47 7B 90 5F C1 3E 10 02 7A DA 98 0F D7 C2 B7 0F    G{..._.}..z.......
000FC0: 7B B7 CA A6 0F C3 A2 0F B7 CA A6 0F 7B FE FF CA    {...........{...
000FC0: F6 40 77 3E 13 [illegible] D1 D5 C5 C5 21 D8 0F E5 [illegible] 0A    .@w>......!.....
000FD0: 6F 03 0A 67 01 03 00 E9 C1 D1 E1 F1 C9 F5 E5 D5    o..g............
000FE0: C5 21 08 00 39 4E 23 46 23 5E 23 56 70 2B 71 C1    .!..9N#F#^#Vp+q.
000FF0: 21 11 00 19 16 00 3E 0E 72 2B 3D C2 F8 0F 71 2B    !.....>.r+=...q+
001000: 78 E6 01 D1 D5 C2 0B 10 11 07 11 72 2B 73 2B 36    x..........r+s+6
001010: 00 D1 E1 F1 33 33 C9 F5 E5 D5 21 0D 00 09 7E 12    ....33....!.....
001020: 13 23 7E 12 13 23 23 7E 1F 2B 7E 17 0F 12 13 23    .#...##..+.....#
001030: 23 7E 17 2B 7E 1F 12 D1 E1 F1 C9 E5 0A E6 17 FE    #..+............
001040: 15 CA 61 10 E6 10 CA 3C 10 21 11 00 09 7E 17 D2    ..a....<.!.....
001050: 57 10 3E 30 C3 5E 10 3E 50 C3 5E 10 3E 80 02 E1    W.>0.^.>P.^.>...
001060: C9 C5 C3 21 71 10 E5 03 0A 6F 03 0A 67 01 07 00    ...!q....o..g...
001070: E9 C1 0A C3 5E 10 0A E6 17 FE 15 CA DC 10 21 02    ....^.........!.
001080: 00 19 7E 17 23 7E 17 26 00 D2 8E 10 26 80 57 CA    ....#..&....&...
001090: BD 10 FE FF CA DF 10 6F E5 26 01 0A E6 10 7C CA    .......o.&.....|.
0010A0: AF 10 B7 CA AA 10 3E 02 E1 C9 3E 05 C3 A8 10 B7    ......>...>.....
0010B0: CA B8 10 3E 03 C3 A8 10 3E 04 C3 A8 10 21 03 00    ...>....>....!..
0010C0: 19 3E 00 BE C2 DF 10 2B BE C2 DF 10 2B BE C2 DF    .>.....+....+...
0010D0: 10 2B BE C2 DF 10 26 00 E5 C3 9B 10 3E 01 C9 03    .+....&.....>...
0010E0: 03 03 0A F6 80 02 0B 0B 0B 0A E6 16 F6 06 C2 97    ................
0010F0: C9 F5 E5 D5 97 02 21 11 00 09 57 3E 0D 72 2B 3D    ......!...W>.r+=
001100: C2 FD 10 D1 E1 F1 C9 F5 C5 E5 79 D5 21 0B 00 39    ..........y.!..9
001110: 5E 23 56 23 4E 23 46 72 2B 73 D1 FE 01 CA 41 11    ^#V#N#Fr+s....A.
001120: FE 02 CA 41 11 FE 03 CA 41 11 FE 04 CA 41 11 FE    ...A....A....A..
001130: 05 CA 89 11 FE 06 CA B5 11 FE 0A CA 41 11 C3 EF    ............A...
001140: 11 0A E6 07 FE 01 CA 5B 11 FE 02 CA 5B 11 FE 03    .......[....[...
001150: CA 6E 11 FE 04 CA 03 11 C3 EF 11 21 80 7F E5 21    .n.........!...!
001160: 00 00 E5 39 EB CD A0 0D EB E1 E1 C3 EF 11 21 10    ...9..........!.
001170: 00 09 36 FE 2B 36 FF 2B 36 FF 2B 36 FF 3E 10 02    ..6.+6.+6.+6.>..
001180: C2 EF 11 CD F1 10 C2 EF 11 0A E6 07 FE 03 C2 EF    ................
001190: 11 3E 10 02 21 11 00 09 7E B7 3E 00 C2 A1 11 3E    .>..!.....>....>
0011A0: FF 12 13 12 13 12 13 7E B7 C2 AE 11 3E 7F 12 1B    ...........>....
0011B0: 1B 1B C3 EF 11 0A E6 1F 02 E6 07 FE 06 CA EF 11    ................
0011C0: D5 21 0D 00 09 1A BE C2 EE 11 13 23 1A BE C2 EE    .!.........#....
0011D0: 11 13 23 EB 13 1A 1F 1B 1A 17 0F BE C2 EE 11 23    ..#...........#
0011E0: 13 13 1A 17 13 1A 1F BE C2 EE 11 3E 95 02 D1 E1    ...........>....
0011F0: C1 F1 33 33 C9 F5 E5 0A E6 17 FE 15 CA 0F 12 E6    ..33............
001200: 10 CA 0C 12 21 11 00 09 7E C6 80 77 E1 F1 C9 C5    ....!.....w.....
001210: C5 21 1F 12 E5 03 0A 6F 03 0A 67 01 08 00 E9 C1    .!.....o..g.....
001220: C3 0C 12 17 D2 2A 12 09 CE 00 29 17 D2 32 12 09    .....*....)..2..
001230: CE 00 29 17 D2 3A 12 09 CE 00 29 17 D2 42 12 09    ..)..:....)..B..
001240: CE 00 29 17 D2 4A 12 09 CE 00 29 17 D2 52 12 09    ..)..J....)..R..
001250: CE 00 29 17 D2 5A 12 09 CE 00 29 17 D2 62 12 09    ..)..Z....)..b..
[illegible]): CE 00 C9 06 00 57 79 17 7A DB E6 C0 5F 7B 17 5F    .....Wy.z....{._
[illegible]: 7D 17 6F 7C 17 67 79 17 4F 04 17 D2 6D 12 7A E6    }.o|.gy.O...m.z.
001280: 20 B3 C9 00 00 20 41 00 00 CB 42 00 40 1C 46 20    .... A...B.@.F
001290: BC BE 4C CA 1B 0E 5A AE C5 9D 74 16 00 C5 D5 60    ..L...Z...t....`
0012A0: 69 5E E5 23 56 23 4E 23 46 E1 EB CD ED 12 DA E8    i^.#V#N#F.......
0012B0: 12 CD ED 12 DA E8 12 1A 85 6F 13 1A 8C 67 13 1A    .........o...g..
0012C0: 89 4F 13 1A 88 47 DA E8 12 CD ED 12 DA E8 12 D1    .O...G..........
0012D0: 19 3E 00 89 4F 3E 00 88 47 DA E9 12 EB E1 73 23    .>..O>..G.....s#
0012E0: 72 23 71 23 70 3E 00 C9 E1 D1 3E FF C9 29 79 17    r#q#p>....>..)y.
0012F0: 4F 78 17 47 C9 C6 80 57 7D CE 00 6F 7C CE 00 67    Ox.G...W}..o|..g
001300: 79 CE 00 4F DA 12 13 7A B7 C2 10 13 7D E6 FE 6F    y..O...z....}..o
001310: 97 C9 0E 80 3E 01 C9 16 00 FE 20 DA 20 13 3E 20    ....>..... . .>
001320: FE 08 DA 3F 13 5F 7D E6 3F B2 16 20 C2 31 13 16    ...?._}.?.. .1..
001330: 00 7D E6 C0 B2 57 6C 61 48 7B D6 08 C3 20 13 B7    .}...WlaH{... ..
001340: CA 5F 13 5F 7B 0F 47 79 1F 4F 7C 1F 67 7D 1F 6F    ._._x.Gy.O|.g}.o
001350: 7A 1F 57 17 E6 20 B2 E6 E0 57 7B 3D C3 3F 13 7A    z.W.. ...W{=.?.z
001360: C9 69 60 4E 23 46 1A 81 6F 13 1A 88 67 C9 EB 5F    .i`N#F..o...g..._
001370: 16 00 EB 1A 85 6F 13 1A 8C 67 C9 EB 5F 16 00 EB    .....o...g.._...
001380: 1A A5 6F 13 1A A4 A7 C9 44 4D 21 00 00 3F 10 FF    ..o.....DM!..?..
001390: 9E 57 CD C9 5F [illegible] EB 7D 2F 6F 7C 2F 67 C9 [illegible] 23    .W..YP.}/o|/g.^#
0013C0: 56 EB 7C B7 1F 67 7D 1F 6F 0D C2 C2 13 C9 5F 16    V.|..g}.o......_.
0013D0: 00 7B 95 6F 7A 9C 67 C9 4F 06 00 7B 91 6F 7A 98    .{.oz.g.O..{.oz.
0013E0: 67 C9 69 60 4E 23 46 1A 91 6F 13 1A 98 67 C9 6F    g.i`N#F..o...g.o
0013F0: 26 00 1A 95 6F 13 1A 9C 67 C9 5F 16 00 7B 96 5F    &...o...g._..{._
001400: 7A 23 9E 57 EB C9 E5 D5 C5 F5 21 0B F0 35 7E FE    z#.W......!..5..
001410: 00 C2 2B 14 3A 7C F0 F6 02 2F D3 E8 3A 40 00 32    ..(.:|.../..:@.2
001420: 08 F0 3A 7C F0 2F B3 E8 21 B2 F0 36 00 3E 01 21    ..:|./..!..6.>.!
001430: B2 F0 BE DA 5A 14 7A B2 F0 26 00 01 04 F0 29 09    ....Z.*..&....).
001440: E5 2A B2 F0 26 00 01 41 F0 29 09 E3 4E 23 46 E1    .*..&..A.)..N#F.
```

```
001450: 71 23 70 21 B2 F0 34 C2 2D 14 01 04 F0 CD 54 02    q#p!..4.-.....T.
001460: 21 B2 F0 36 00 3E 01 21 B2 F0 3E DA 92 14 2A B2    !..6.>.!......*.
001470: F0 26 00 01 39 F0 29 09 E5 2A B2 F0 26 00 01 3B    .&....9.)..*..&..=
001480: F0 29 09 E3 4E 23 46 E1 71 23 70 21 B2 F0 34 C2    .)..N#F.q#p!..4.
001490: 6D 14 3E 01 21 49 F0 BE D2 9F 14 21 49 F0 35 3A    o.>.!I.....!I.5:
0014A0: 49 F0 FE 01 C2 AC 14 21 46 F0 36 01 3E 20 D3 D8    I......!H.6.> ..
0014B0: F1 C1 D1 E1 FB C9 E5 D5 C5 F5 CD 30 02 21 B3 F0    ............<.!..
0014C0: 3E 00 3E 01 21 B3 F0 3E DA CF 14 2A B3 F0 26 00    6.>.!......*..&.
0014D0: 01 00 F0 29 09 E5 2A B3 F0 26 00 01 39 F0 29 09    ...)..*..&..9.).
0014E0: E3 4E 23 46 E1 71 23 70 21 B3 F0 34 C2 C2 14 01    .N#F.q#p!..4....
0014F0: 00 F0 CD 54 02 21 B3 F0 36 00 3E 01 21 B3 F0 BE    ...T.!..6.>.!...
001500: DA 27 15 2A B3 F0 26 00 01 00 F0 29 09 E5 2A B3    .'.*..&....)..*.
001510: F0 26 00 01 35 F0 29 09 E3 4E 23 46 E1 71 23 70    .&..5.)..N#F.q#p
001520: 21 B3 F0 34 C2 FA 14 CF 20 D3 D8 F1 C1 D1 E1 FB    !..4...> .......
001530: C9 E5 D5 C5 F5 CD 49 02 2A 45 F0 2B 22 45 F0 3E    ......I.*E.+"E.>
001540: 20 D3 D8 F1 C1 D1 E1 FB C9 E5 D5 C5 F5 21 B4 F0     .............!..
001550: 36 00 3E 07 21 B4 F0 BE DA 78 15 2A B4 F0 26 00    6.>.!....x.*..&.
001560: 01 9D F0 09 E5 2A B4 F0 26 00 01 AE F0 09 D1 1A    .....*..&.......
001570: 77 21 B4 F0 34 C2 57 15 21 49 F0 36 03 3E 20 D3    w!..4.R.!I.6.> .
001580: D8 F1 C1 D1 E1 FB C9 E5 D5 C5 F5 F3 21 94 15 E5    .............!...
001590: 2A 01 00 E9 F1 C1 D1 E1 FB C9 E5 D5 C5 F5 3E 20    *.............>
0015A0: D3 D8 F1 C1 D1 E1 FB C9                            ........
```

We claim:

1. A method of controlling the operation of a sheet winder having a winding roll, a support drum and a winder drive, comprising the steps of:

storing target information indicating the length of sheet to be wound;

driving the winder to wind the sheet thereon;

counting and storing the numbers of revolutions of the roll and the drum and therefrom calculating the cumulative length on the roll;

repetitively sampling the drum revolution counts and comparing the current drum revolution count with the last-sampled count to determine speed;

calculating anticipated stopping distance from the speed and drive deceleration rate;

comparing the anticipated stopping distance and the cumulative length to the target length;

operating the winder drive at a first deceleration rate when the sum of the anticipated stopping distance and the cumulative length is greater than the target length and at a lower, second deceleration rate when such sum is less than the target length.

2. The method of claim 1, wherein:

the step of storing target information is further defined as storing target diameter information including sheet caliper; and the anticipated stopping distance is calculated in accordance with the relationship $$D(NT) = \left\{ \frac{48c}{\pi} - \frac{V^2[(N-1)T]}{2a} + D^2[(N-1)T] \right\}^{\frac{1}{2}}$$

where

V[(N−1)T] is the speed in ft/sec computed from the last sample,

D[(N−1)T] is the roll diameter in inches at the last sample,

D(NT) is the stopping diameter in inches at the current sample, c is the sheet caliper in inches, and a is the deceleration rate.

3. The method of claim 2, wherein, in the event of sheet break, slabbing off and splicing, the further step of:

calculating the decremental drum revolution count in accordance with the relationship $$\Delta CT = n(D_L^2 - D_I^2)/96c,$$

where

ΔCT is the decremental drum count, n is the number of drum counts per revolution, $D_L^2$ is the last diameter before sheetbreak, and $D_I^2$ is the new diameter after sheetbreak.

4. The method of claim 3, and further comprising the step of:

subtracting the decremental length ΔCT from the cumulated length to compensate for the slabbed-off length.

5. The method of claim 1, wherein the step of calculating the stopping distance is further defined as:

calculating the stopping distance in accordance with the relationship stopping distance=(speed ** 2)/2 * a where

** is the Fortran code for "raised to the power of",

* is the code for "multiply by", and a is the deceleration rate.

6. The method of claim 1, wherein a time lag occurs in the drive the first time the first deceleration rate is applied, and further comprising the step of:

applying a time advance factor to advance the first application of the first deceleration rate to compensate for the time lag.

7. A winder control comprising:

a rotatable support drum and a drum tachometer for producing first tachometer pulses;

a rotatable roll for winding a sheet thereon and a roll tachometer for producing second tachometer pulses;

drive means connected to and operable to cause rotation of said drum and roll, including a drive circuit switchable between a first deceleration rate and a lower second deceleration rate;

first means for storing target information representing desired wound up sheet length;

second means connected to said drum and roll tachometers for counting and storing the respective tachometer pulses as representing an cumulative length; and said second means including third means connected to said first means and to said drive circuit, said third means operable to determine an anticipated stopping distance from the speed and the drive deceleration rate and cause said drive circuit to operate at said first deceleration rate when the sum of the stopping distance and the cumulative length is greater than the target length and at said lower, second deceleration rate when such sum is less than the target length.

* * * * *